US008578512B2

(12) United States Patent
Moore et al.

(10) Patent No.: US 8,578,512 B2
(45) Date of Patent: Nov. 12, 2013

(54) SIPED WETSUIT

(75) Inventors: Bruce Yin Moore, Laguna Beach, CA (US); Ryan Michael Hurley, Costa Mesa, CA (US)

(73) Assignee: Nike, Inc., Beaverton, OR (US)

( * ) Notice: Subject to any disclaimer, the term of this patent is extended or adjusted under 35 U.S.C. 154(b) by 70 days.

(21) Appl. No.: 13/213,634

(22) Filed: Aug. 19, 2011

(65) Prior Publication Data

US 2013/0042377 A1 Feb. 21, 2013

(51) Int. Cl.
*B63C 11/04* (2006.01)

(52) U.S. Cl.
USPC ..... 2/2.16; 2/2.15; 2/2.17; 2/67

(58) Field of Classification Search
USPC ..... 2/2.15–2.17, 67, 238, 82
See application file for complete search history.

(56) References Cited

U.S. PATENT DOCUMENTS

| | | | | |
|---|---|---|---|---|
| 5,052,053 | A * | 10/1991 | Peart et al. | 2/2.16 |
| 5,622,762 | A * | 4/1997 | Perla | 428/43 |
| 5,768,703 | A * | 6/1998 | Machado et al. | 2/2.15 |
| 5,896,578 | A * | 4/1999 | Hunter et al. | 2/2.15 |
| 5,898,934 | A * | 5/1999 | Hunter et al. | 2/2.15 |
| 6,623,839 | B2 * | 9/2003 | Hu | 428/172 |
| 6,708,528 | B2 * | 3/2004 | Chuang | 66/171 |
| 7,051,375 | B2 * | 5/2006 | Polak et al. | 2/82 |
| 7,631,363 | B2 | 12/2009 | Myerscough | |
| 7,937,852 | B1 | 5/2011 | Krehbiel | |
| 7,941,871 | B1 | 5/2011 | Jorgensen | |
| 7,992,218 | B2 * | 8/2011 | O'Hara | 2/2.15 |
| 8,032,944 | B2 * | 10/2011 | Demetropoulos | 2/2.16 |
| 2003/0140391 | A1 * | 7/2003 | Richards et al. | 2/67 |
| 2003/0172429 | A1 * | 9/2003 | Chuang | 2/2.15 |
| 2005/0071905 | A1 * | 4/2005 | Polak et al. | 2/2.16 |
| 2007/0277277 | A1 * | 12/2007 | Moore | 2/2.15 |
| 2009/0126061 | A1 * | 5/2009 | O'Hara | 2/2.17 |
| 2010/0269238 | A1 * | 10/2010 | O'Hara | 2/2.17 |
| 2012/0023631 | A1 * | 2/2012 | Fischer | 2/2.15 |

FOREIGN PATENT DOCUMENTS

| | | |
|---|---|---|
| EP | 1588635 | 10/2005 |
| WO | 2007111753 | 10/2007 |

OTHER PUBLICATIONS

International Search Report and Written Opinion in PCT Application No. PCT/US2012/050265, Mailed on Jan. 2, 2013.

* cited by examiner

*Primary Examiner* — Khoa Huynh
*Assistant Examiner* — Andrew W Collins
(74) *Attorney, Agent, or Firm* — Plumsea Law Group, LLC

(57) ABSTRACT

A wetsuit for aquatic activities is disclosed below. The wetsuit includes a base layer and a backing layer. The base layer may be formed from a thermal insulation material, for example, and the base layer has a first surface and an opposite second surface. The backing layer is secured to the first surface of the base layer, and the backing layer has less stretch than the base layer. In addition, the wetsuit includes a plurality of sipes extending through at least the backing layer.

32 Claims, 27 Drawing Sheets

SIPED WETSUIT

BACKGROUND

Wetsuits are commonly worn to provide thermal insulation, buoyancy, and abrasion resistance while engaging in various aquatic activities, such as surfing, scuba diving, snorkeling, open water swimming, kayaking, and windsurfing. Although wetsuits may also be formed from various materials, a majority of wetsuits incorporate neoprene (i.e., polychloroprene), which a synthetic rubber produced by the polymerization of chloroprene. Moreover, neoprene for wetsuits is generally foamed, often with nitrogen gas, to form gas-filled cells within the material, which enhance thermal insulation and buoyancy properties. Typically, backing layers (e.g., nylon textile elements) are secured to opposite surfaces of a neoprene element to impart strength and abrasion-resistance.

Features of wetsuits may vary depending upon the specific aquatic activity or water temperature for which the wetsuits are designed. As an example, a wetsuit for activities that require significant movement (e.g., surfing and windsurfing) may have backing materials with elastane (i.e., spandex) to reduce limitations on movement while wearing the wetsuit. A wetsuit for scuba diving or colder waters may include water-resistant seals (e.g., rubber cuffs) at wrist, ankle, and neck openings to limit the entry of water. Additionally, a wetsuit for open water swimming may only include a single layer of backing material located on an inner surface (i.e., facing and contacting the wearer) to reduce drag, although additional texture may be included in arm areas to enhance pull during swimming. Moreover, some wetsuits primarily cover only the torso of a wearer to impart a greater freedom of movement in the arms and legs, while other wetsuits may cover the torso, arms, and legs to impart greater thermal insulation. As a further example, wetsuits designed for warmer waters may incorporate relatively thin neoprene elements (e.g., 0.5-2 millimeters), whereas wetsuits designed for colder waters may incorporate relatively thick neoprene elements (e.g., 2-6 millimeters or more). Accordingly, multiple features of wetsuits may vary considerably.

SUMMARY

A wetsuit for aquatic activities is disclosed below. The wetsuit includes a base layer and a backing layer. The base layer may be formed from a thermal insulation material, for example, and the base layer has a first surface and an opposite second surface. The backing layer is secured to the first surface of the base layer, and the backing layer has less stretch than the base layer. In addition, the wetsuit includes a plurality of sipes extending through at least the backing layer.

The features of the wetsuit may vary considerably. In another configuration, the wetsuit includes a polymer foam layer, a first backing layer, and a second backing layer. The polymer foam layer has a first surface and an opposite second surface. The first backing layer is secured to the first surface of the polymer foam layer and forms at least a portion of an exterior surface of the wetsuit. The first backing layer also defines a plurality of sipes that expose a portion of the polymer foam layer. The second backing layer is secured to the second surface of the polymer foam layer and forms at least a portion of an interior surface of the wetsuit.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of a wetsuit with sipes. Although the sipes may have a variety of structures, the sipes may be incisions, cuts, indentations, spaces, gaps, or grooves in the wetsuit. Advantages of the sipes include enhancing stretch and flex properties of the wetsuit.

Wetsuit Configuration

Figure 1:
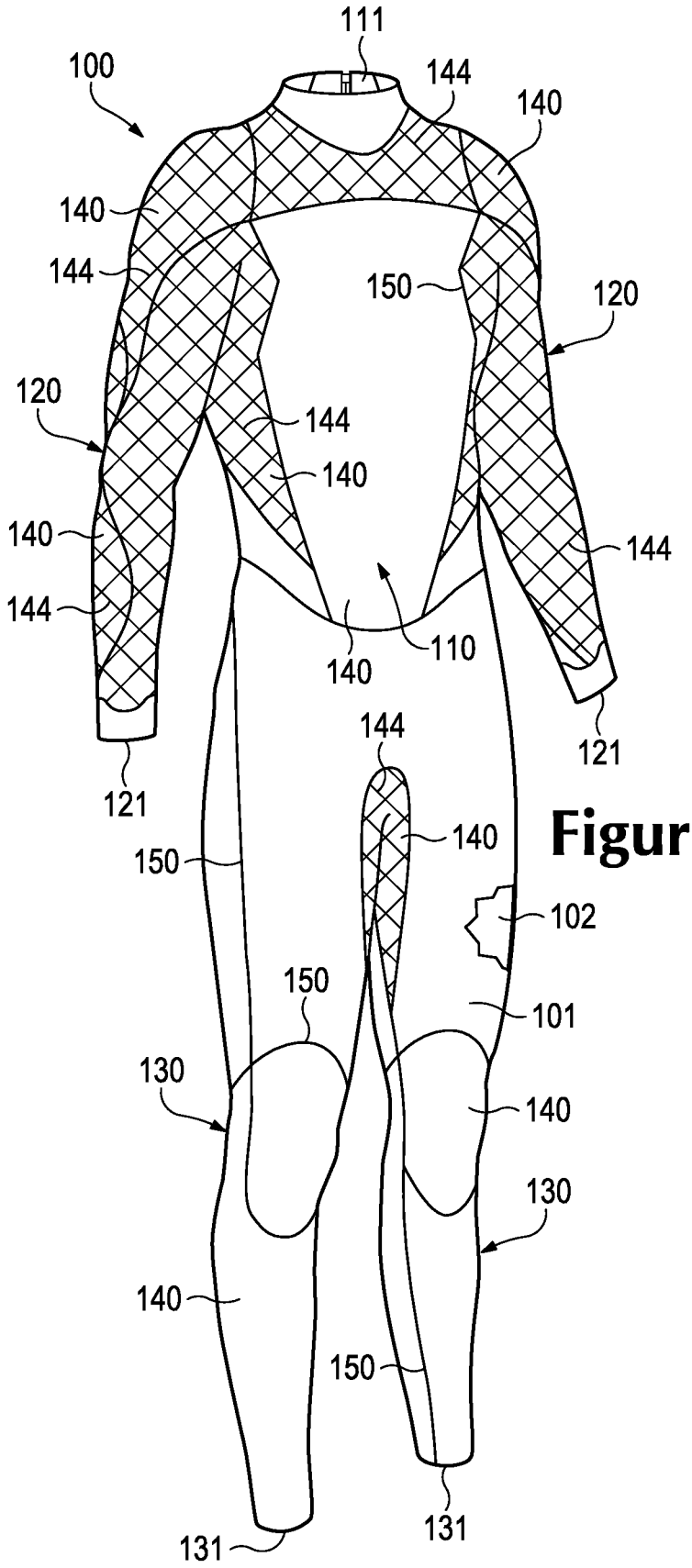
FIGS. 1 and 2 are perspective views of a wetsuit for aquatic activities.
Figure 2:
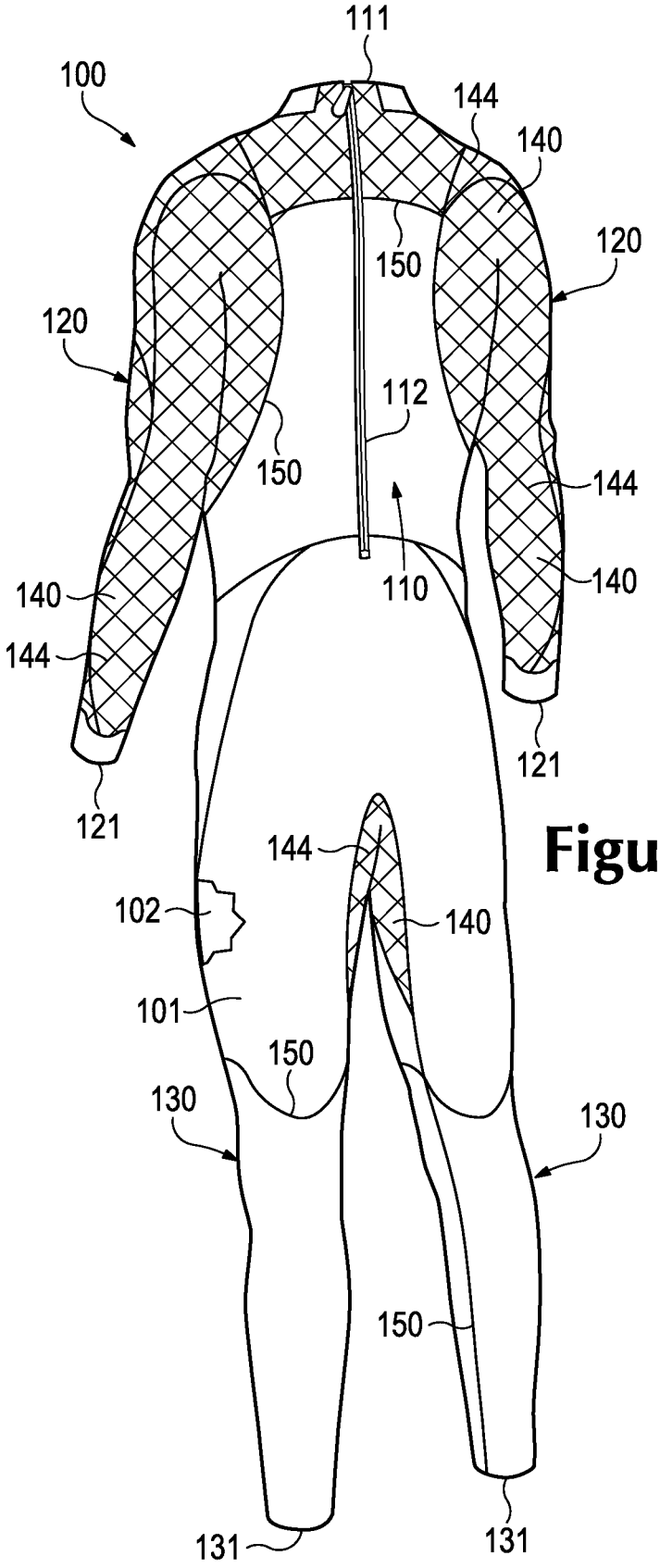

A wetsuit 100 is depicted in FIGS. 1 and 2 as including a torso region 110, a pair of arm regions 120, and a pair of leg regions 130. Torso region 110 covers a torso of an individual when wetsuit 100 is worn. More particularly, torso region 110 extends from a neck and shoulders of the individual to a pelvic area of the individual, thereby covering the chest, back, and sides of the individual. An upper area of torso region 110 defines a neck opening 111 that extends around a neck of the individual. A zippered opening 112 also extends downward through a portion of a back area of torso region 110 to facilitate entry and removal of wetsuit 100, although other types and locations of openings may be utilized. Arm regions 120 cover at least a portion of a right arm and a left arm of the individual when wetsuit 100 is worn. End areas of arm regions 120 each define a wrist opening 121 that extends around a wrist of the individual. Leg regions 130 cover at least a portion of a right leg and a left leg of the individual when wetsuit 100 is worn. Lower areas of leg regions 130 each define an ankle opening 131 that extends around an ankle of the individual. Wetsuit 100 also includes an exterior surface 101 that faces away from the individual and an opposite interior surface 102 that faces toward the individual and may contact the individual.

Wetsuit 100 is generally formed from a plurality of material elements 140 that are joined at various seams 150. Although a variety of methods may be utilized to join material elements 140 at seams 150, one or more of adhesive bonding, thermal bonding, taping, and stitching (e.g., blind stitching) may be utilized. In addition to material elements 140, wetsuit 100 may include various additional elements not depicted in the figures. As an example, wetsuit 100 may include seals (e.g., rubber rings) around openings 111, 121, and 131 to limit the flow of water into wetsuit 100 and between interior surface 102 and the individual. A zipper and seal may also be included at zippered opening 112. Abrasion-resistant elements may also be located at knee and elbow areas, for example. Additionally, indicia identifying the manufacturer, placards providing instructions on the care of wetsuit 100, and various aesthetic features may be located on either of surfaces 101 and 102.

Figure 3:
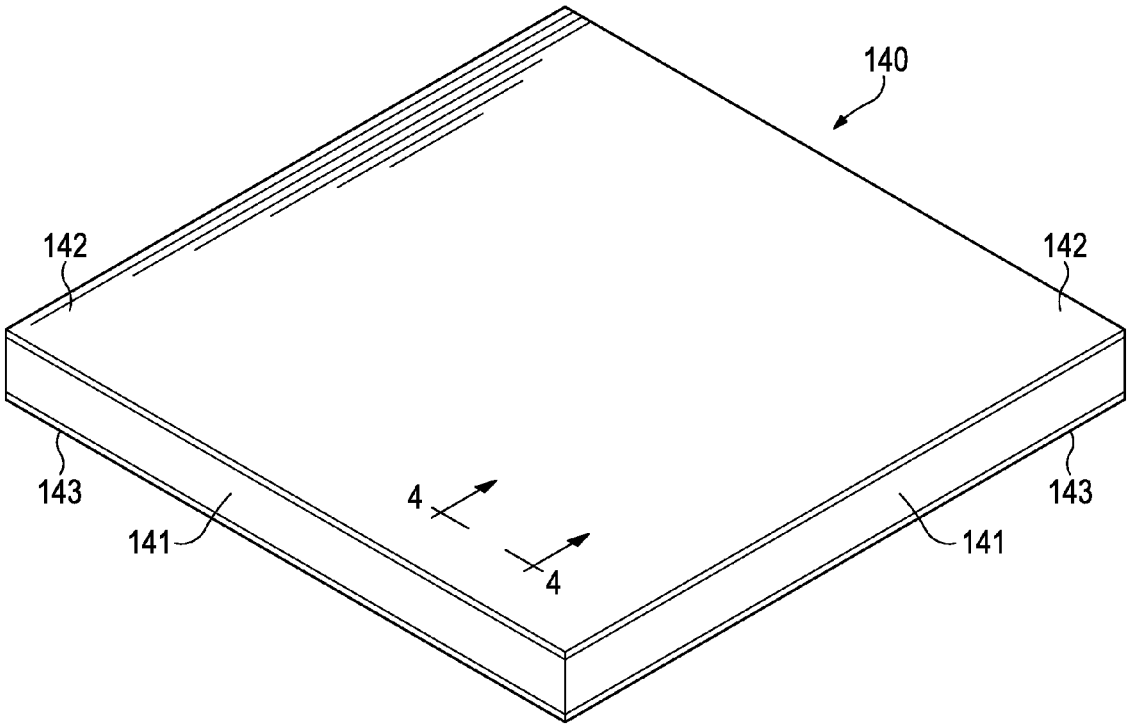
FIG. 3 is a perspective view of a portion of a material element from the wetsuit.
Figure 4:
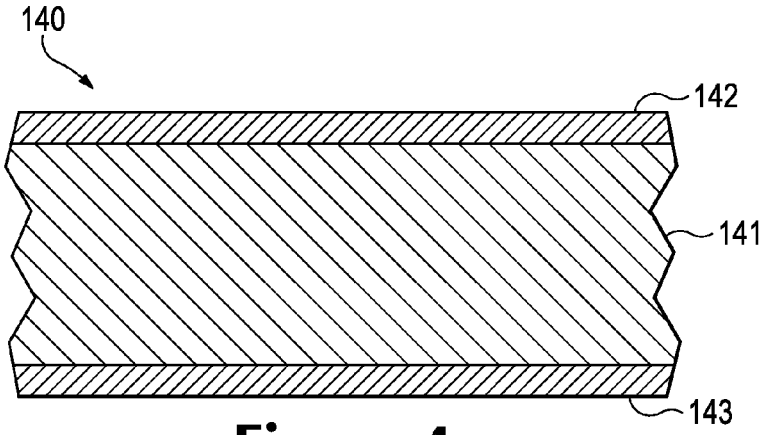
FIG. 4 is a cross-sectional view of the material element depicted in FIG. 3.

A portion of one of material elements 140 is depicted in FIGS. 3 and 4 as including a base layer 141, an exterior backing layer 142, and an interior backing layer 143. Base layer 141 is located between and joined with exterior backing layer 142 and interior backing layer 143. That is, backing layers 142 and 143 are secured to opposite surfaces of base layer 141. Whereas exterior backing layer 142 may form a portion of exterior surface 101, interior backing layer 143 may form a portion of interior surface 102.

A variety of materials may be utilized for base layer 141 and backing layers 142 and 143. In general, base layer 141 may be formed from any of a variety of materials that impart thermal insulation and buoyancy during aquatic activities. As an example, base layer 141 may incorporate a polymer foam material, such as neoprene, which is also referred to as polychloroprene. Neoprene is a synthetic rubber produced by the polymerization of chloroprene. Although non-foamed neoprene may be utilized, neoprene may also be foamed (e.g., with nitrogen gas or other foaming processes) to form gas cells within base layer 141, which enhance the thermal insulation and buoyancy properties of wetsuit 100. Other expansion processes may also be utilized, including a natural foaming process. Examples of additional suitable materials for base layer 141 include other foamed polymer materials (e.g., polyurethane, ethylvinylacetate), various types of rubbers (e.g., sponge rubber, natural rubber, non-foamed rubber), and polymer sheets. In general, backing layers 142 and 143 may be formed from any of a variety of materials that impart strength and abrasion-resistance to wetsuit 100. As an example, backing layers 142 and 143 may be formed from various textiles (e.g., woven, knit, nonwoven), including textiles incorporating nylon. An advantage to nylon relates to its overall durability (e.g., strength, abrasion-resistance), but the textiles of backing layers 142 and 143 may be formed from filaments, fibers, or yarns that include a wide range of materials, including acrylic, cotton, elastane (or spandex), polyamide, polyester, rayon, silk, wool, or combinations of these material. In some configurations, backing layers 142 and 143 may incorporate titanium, carbon fibers, ultrahigh molecular weight polyethylene, or aramid fibers. In addition, polymer sheets or mesh materials may be utilized for backing layers 142 and 143. Moreover, although backing layers 142 and 143 may be formed from the same materials, different materials may be utilized for each of backing layers 142 and 143 to impart different properties to surfaces 101 and 102.

Figure 5:
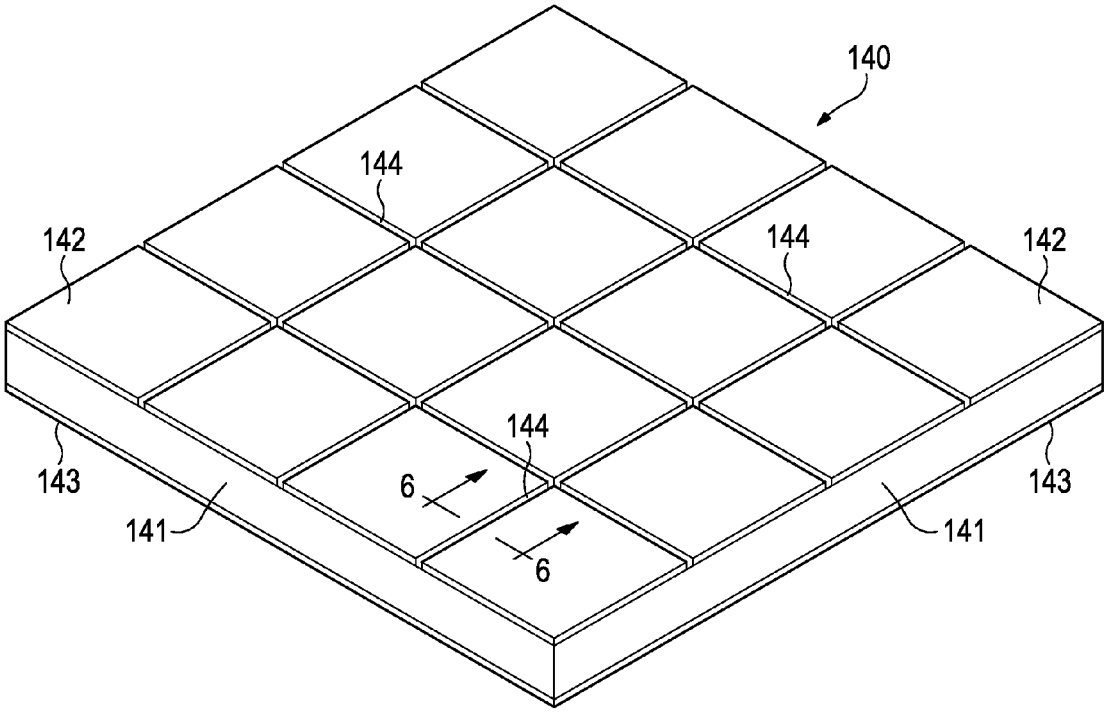
FIG. 5 is a perspective view of a portion of another material element from the wetsuit.
Figure 6:
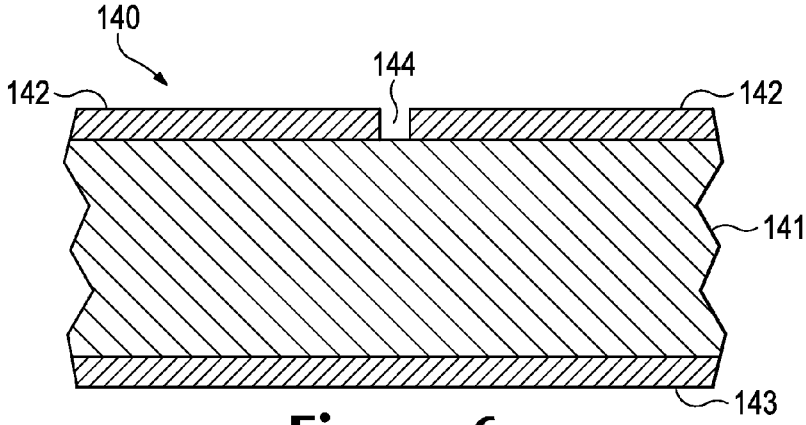
FIG. 6 is a cross-sectional view of the material element depicted in FIG. 5.

In the example of FIGS. 3 and 4, backing layers 142 and 143 are formed from a single component and exhibit an unbroken, uncut, or continuous structure. A portion of another one of material elements 140 is depicted in FIGS. 5 and 6 and also includes base layer 141 and backing layers 142 and 143. In this example, however, a plurality of sipes 144 extend through exterior backing layer 142 and impart a broken, cut, or non-continuous structure.

Sipes 144 may be one or more of incisions, cuts, indentations, spaces, gaps, or grooves in material elements 140. Although sipes 144 may have various configurations, sipes 144 are depicted as having a generally straight structure that forms a checkered pattern in material element 140. That is, a first group of parallel and straight sipes 144 are evenly spaced from each other and extend across material element 140 in a first direction, and a second group of parallel and straight sipes 144 are evenly spaced from each other and extend across material element 140 in a second direction, with the first direction and the second direction being perpendicular to each other. In this configuration, the first group of sipes 144 and the second group of sipes 144 cross each other to effectively subdivide exterior backing layer 142 into multiple separate and square components. In many configurations, sipes 144 will expose portions of base layer 141 such that both base layer 141 and exterior backing layer 142 form exterior surface 101 in the areas of sipes 144. As discussed in greater detail below, sipes 144 may be formed to have a variety of configurations. As such, the configuration of FIGS. 3 and 4 is intended to provide an example of one manner in which sipes 144 may be utilized in wetsuit 100.

Figure 7A:
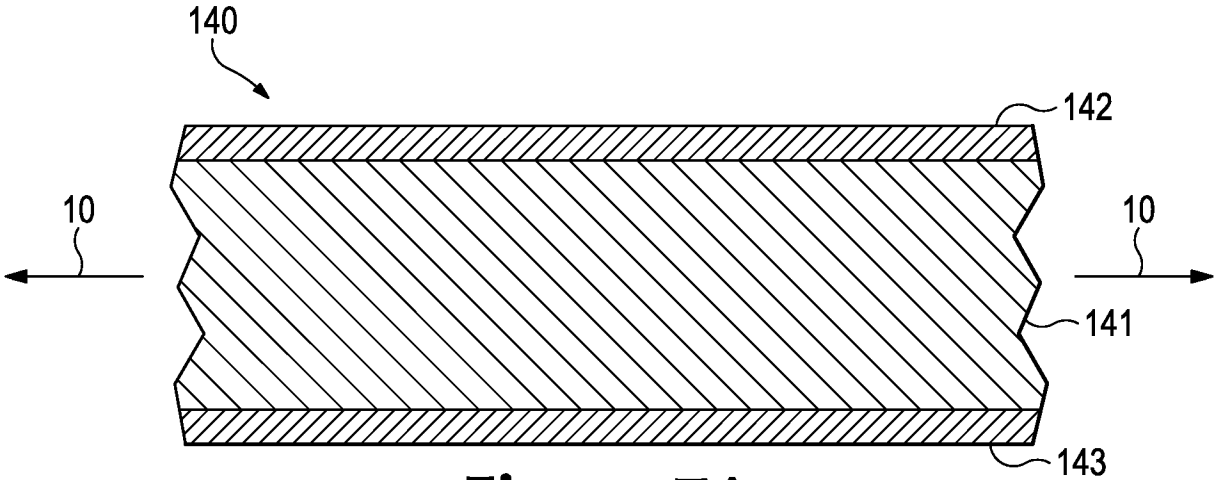
FIGS. 7A and 7B are cross-sectional views respectively corresponding with FIGS. 4 and 6 and depicting the material elements as subjected to a tensile force.
Figure 7B:
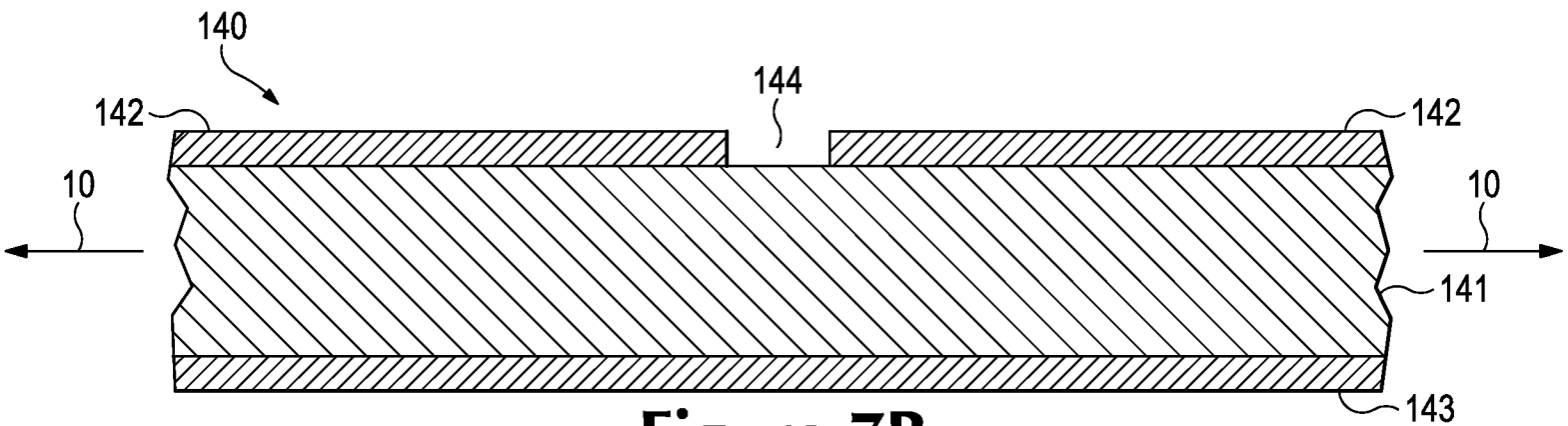

A first advantage of sipes 144 relates to enhancing the stretch properties of wetsuit 100. Areas of wetsuit 100 that include sipes 144 stretch to a greater degree than areas of wetsuit 100 without sipes 144. Similarly, material elements 140 including sipes 144 stretch to a greater degree than material elements 140 without sipes 144. As an example of this concept, FIG. 7A is similar to FIG. 4 and depicts a portion of one of material elements 140 as being subjected to a stretching or tensile force 10. Continuing with the example of this concept, FIG. 7B is similar to FIG. 6 and depicts a portion of another one of material elements 140, which includes sipe 144, as being subjected to tensile force 10. In comparing FIGS. 7A and 7B, the cross-sectional views show greater stretch in FIG. 7B. More particularly, the area of sipe 144 has widened and accounts for a majority of the stretch. Accordingly, sipes 144 may be utilized to increase stretch in specific areas of wetsuit 100.

A rationale for the greater stretch in areas of wetsuit 100 including sipes 144 relates to the absence of exterior backing layer 142. In FIG. 7A, exterior backing layer 142 has an unbroken, uncut, or continuous structure. In FIG. 7B, however, one of sipes 144 forms a broken, cut, or non-continuous structure in exterior backing layer 142. As such, exterior backing layer 142 does not restrict stretch in the area of sipe 144 and facilitates the greater stretch.

Figure 8A:
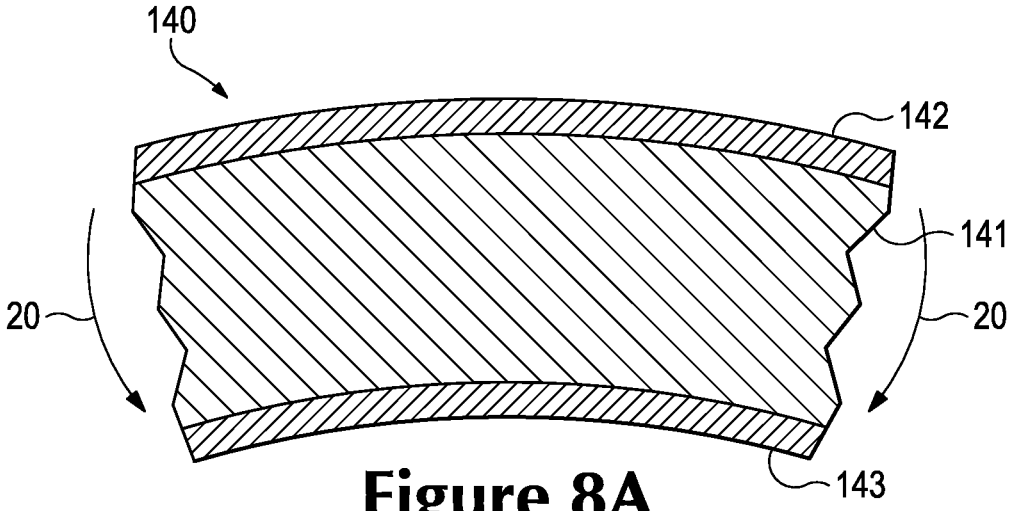
FIGS. 8A and 8B are cross-sectional views respectively corresponding with FIGS. 4 and 6 and depicting the material elements as subjected to a bending force.
Figure 8B:
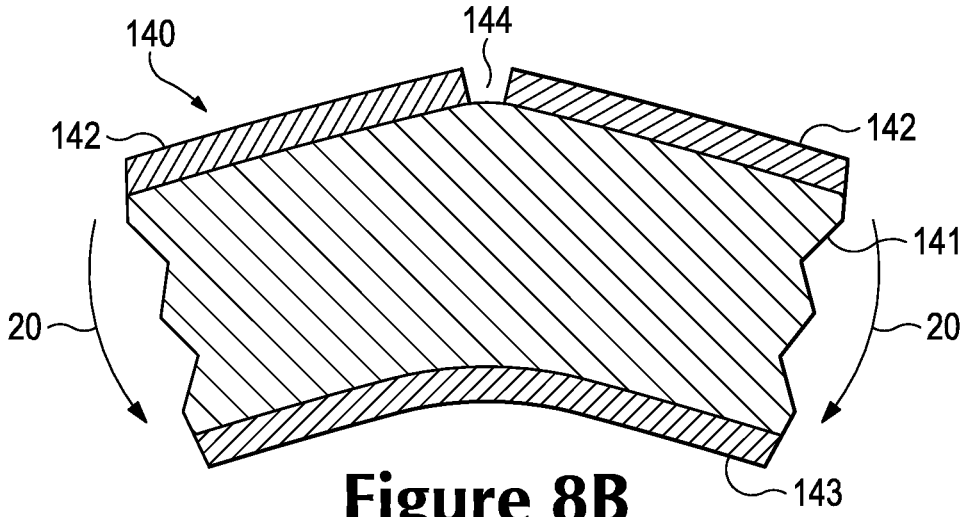

A second advantage of sipes 144 relates to enhancing the flex properties of wetsuit 100. Areas of wetsuit 100 that include sipes 144 flex to a greater degree or more easily than areas of wetsuit 100 without sipes 144. Similarly, material elements 140 including sipes 144 flex to a greater degree or more easily than material elements 140 without sipes 144. As an example of this concept, FIG. 8A is similar to FIG. 4 and depicts a portion of one of material elements 140 as being subjected to a bending force 20. Continuing with the example of this concept, FIG. 8B is similar to FIG. 6 and depicts a portion of another one of material elements 140, which includes sipe 144, as being subjected to bending force 20. In comparing FIGS. 8A and 8B, the cross-sectional views show greater flex in FIG. 8B. More particularly, the area of sipe 144 has widened and accounts for a majority of the flex. Accordingly, sipes 144 may be utilized to increase flex in specific areas of wetsuit 100.

A rationale for the greater flex in areas of wetsuit 100 including sipes 144 relates to the absence of exterior backing layer 142. In FIG. 8A, exterior backing layer 142 has an unbroken, uncut, or continuous structure. In FIG. 8B, however, one of sipes 144 forms a broken, cut, or non-continuous structure in exterior backing layer 142 and at the area of flex. As such, sipes 144 may be utilized to facilitate the greater flex.

A third advantage of sipes 144 relates to enhancing the aesthetic properties of wetsuit 100. Although sipes 144 provide the structural advantages of enhanced stretch and flex, as noted above, sipes 144 may also be utilized to enhance the visual appearance of wetsuit 100. That is, sipes 144 may simultaneously enhance stretch, flex, and visual appearance of wetsuit 100. In some configurations, base layer 141 and exterior backing layer 142 may be formed from materials with different colors or contrasting materials to accentuate the presence of sipes 144. Accordingly, sipes 144 may impart both structural and aesthetic advantages to wetsuit 100.

Any portion of wetsuit 100 may incorporate sipes 144 where enhanced stretch or flex is desired. Although sipes 144 may be formed in all of wetsuit 100, sipes 144 may also be formed in areas of wetsuit 100 where a conventional wetsuit may restrict movements of the individual. In other words, sipes 144 may be formed in areas of wetsuit 100 where greater stretch or flex may permit a greater freedom of movement, for example. Referring again to FIGS. 1 and 2, sipes 144 are present in each of regions 110, 120, and 130. More particularly, sipes 144 are formed (a) in an upper area of torso region 110 on both the front and back, (b) in side areas of torso region 110, (c) throughout arm regions 120, and (d) in leg regions 130, particularly inner thigh areas. Although forming sipes 144 in these areas may enhance movement of the individual for various aquatic activities, locating sipes 144 in other areas may enhance movement for other aquatic activities. In some configurations, sipes 144 may be formed throughout wetsuit 100 to impart greater stretch and flex to all of wetsuit 100. In other configurations, sipes 144 may be formed in at least two of regions 110, 120, and 130 to impart stretch and flex to various areas of wetsuit 100. Accordingly, sipes 144 may be formed in any area or combination of areas to enhance stretch and flex in wetsuit 100.

Further Configurations

The configuration of wetsuit 100 discussed above provides an example of one manner in which sipes 144 may be utilized to enhance stretch and flex, for example, in wetsuit 100. Numerous aspects of wetsuit 100 may, however, vary significantly. As examples of these aspects, the following discussion presents numerous variations in the structure of wetsuit 100, material elements 140, and sipes 144. Although the variations may be utilized individually, the variations may also be utilized in combination to impart a range of properties and other features to wetsuit 100. Accordingly, the configurations discussed herein are intended as examples of the many ways in which wetsuit 100, material elements 140, and sipes 144 may impart enhanced stretch, flex, aesthetics, and other properties.

The general configuration of wetsuit 100 depicted in FIGS. 1 and 2 covers substantially all of the torso, arms, and legs of the individual. As such, wetsuit 100 may be referred to as a "full suit" or "steamer." The use of sipes 144 may, however, be applied to other types of wetsuits, such as (a) a "shorty" or "spring suit" that covers the torso and has short arm regions and leg regions, (b) a "long john" or "johnny suit" that covers the torso and legs only, (c) a "jacket" that covers the torso and arms, with little or no coverage of the legs, and (d) a "vest" that covers the torso and may include a hood for covering a portion of the head. Accordingly, various types of wetsuits may incorporate sipes 144 or other concepts discussed herein.

Figure 9:
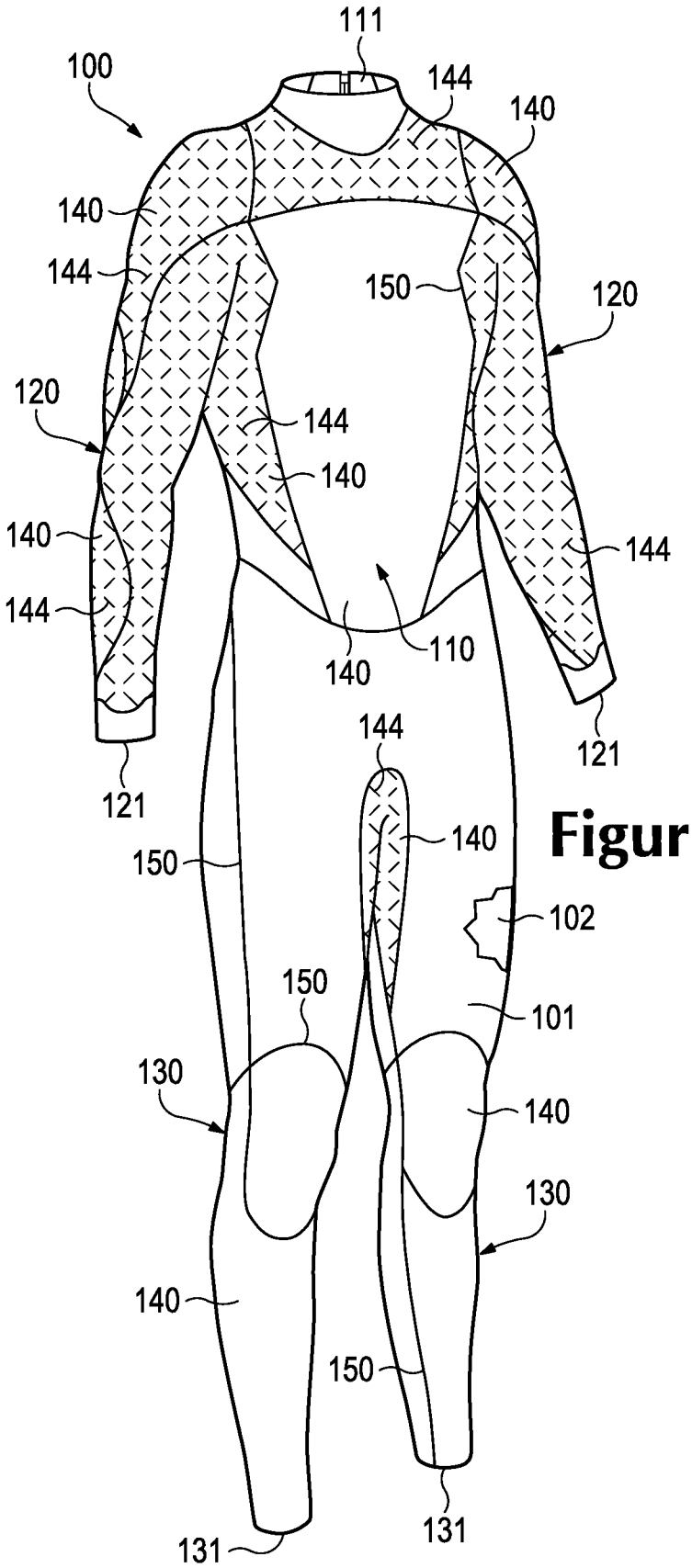
FIGS. 9 and 10 are perspective views of another configuration of the wetsuit.
Figure 10:
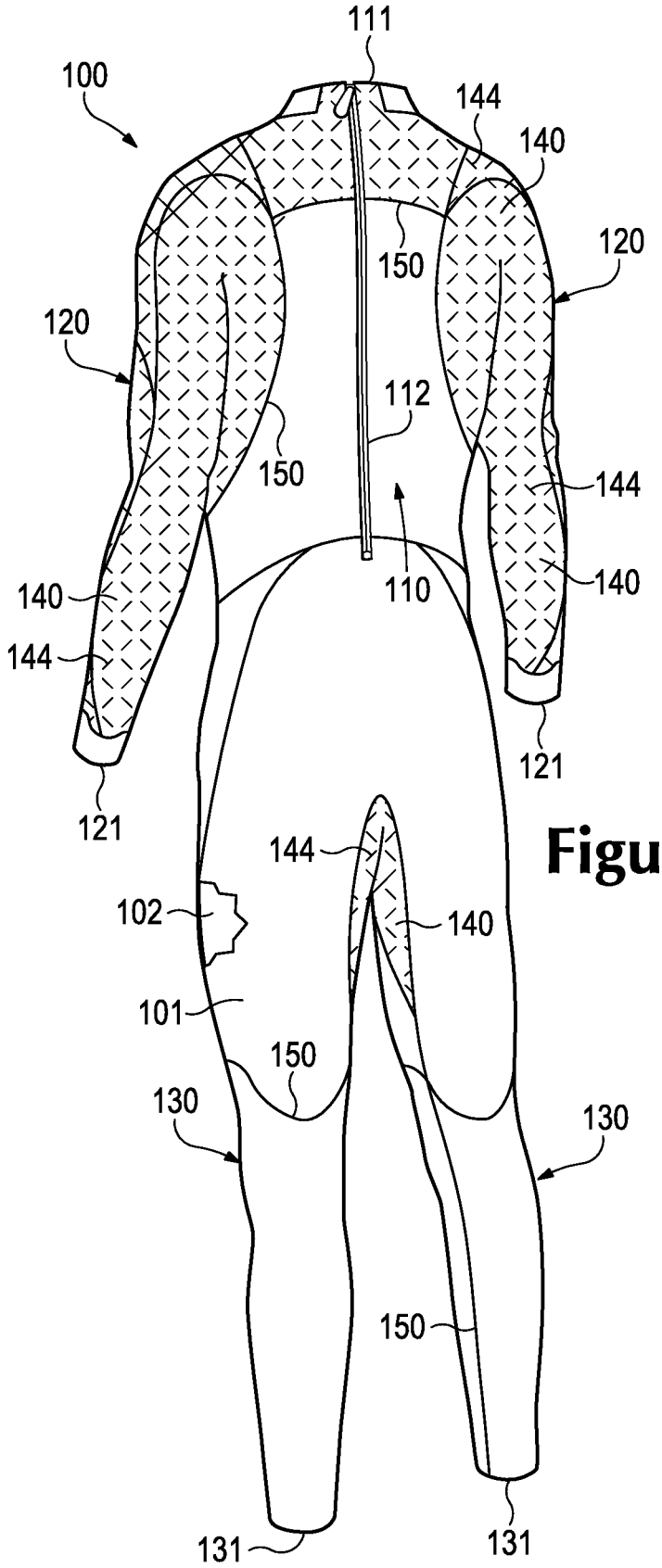
Figure 11:
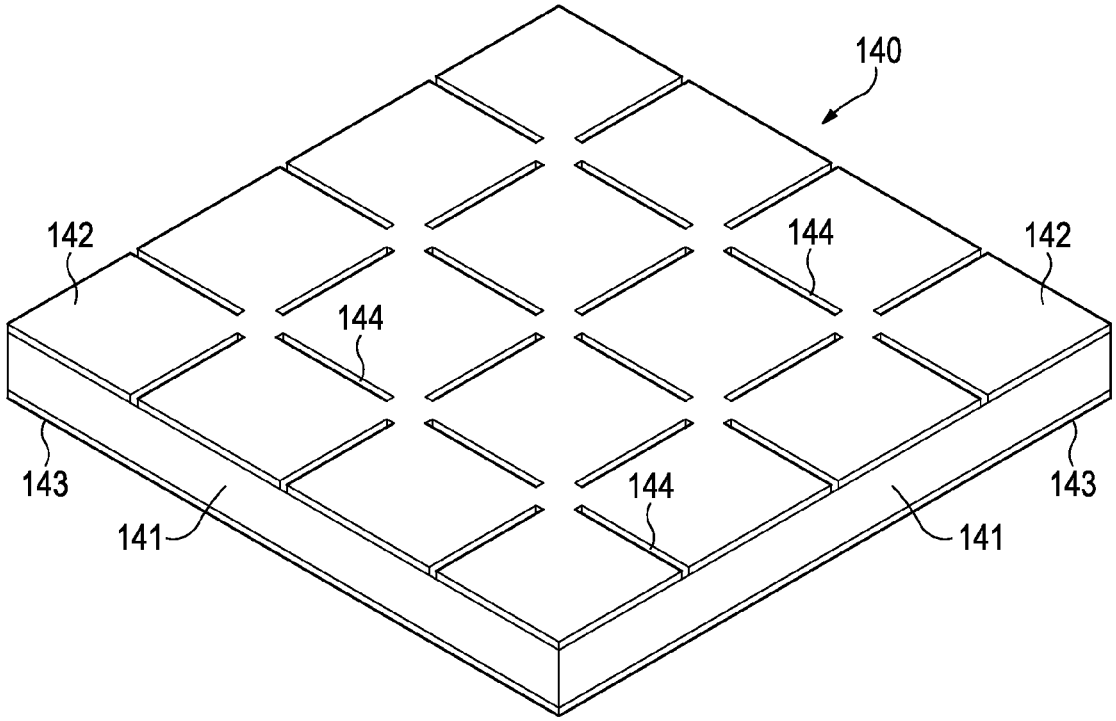
FIG. 11 is a perspective view of a portion of a material element from the wetsuit.

Another version of wetsuit 100 is depicted in FIGS. 9 and 10 as having many of the features discussed above. In contrast, however, sipes 144 exhibit a dashed or non-continuous structure, as best illustrated in FIG. 11. In this configuration, a plurality of individual sipes 144 are aligned and spaced from each other, which effectively forms various sipe lines (i.e., lines formed from multiple sipes 144) that extend across material element 140. In effect, therefore, a first sipe 144 in one of the sipe lines is aligned and spaced from a second sipe 144 in the sipe line, which imparts the dashed or non-continuous structure. Although some of the sipe lines may be parallel to each other, other sipe lines may also cross or intersect each other. For example, FIG. 11 depicts (a) various sipe lines extending across material element 140 in one direction, and these sipe lines are parallel to each other and (b) various sipe lines extending across material element 140 in perpendicular directions, and these sipe lines cross or intersect each other.

Figure 12A:
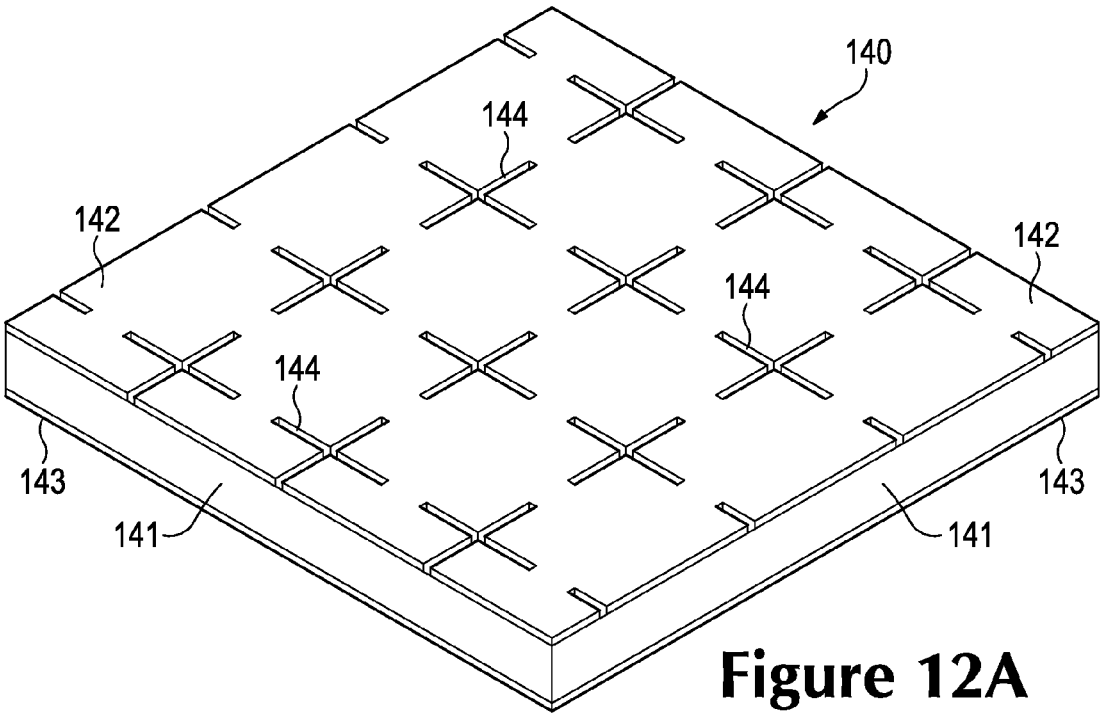
FIGS. 12A-12L are perspective views corresponding with FIG. 5 and depicting further configurations of the material element from the wetsuit.
Figure 12B:
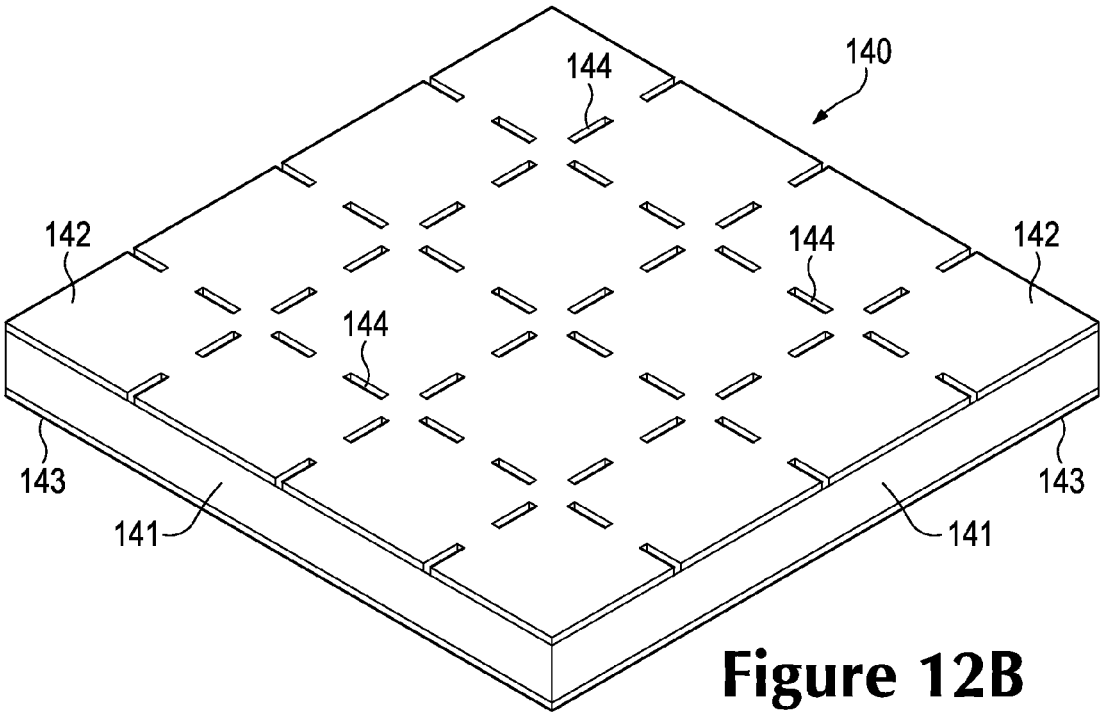
Figure 12C:
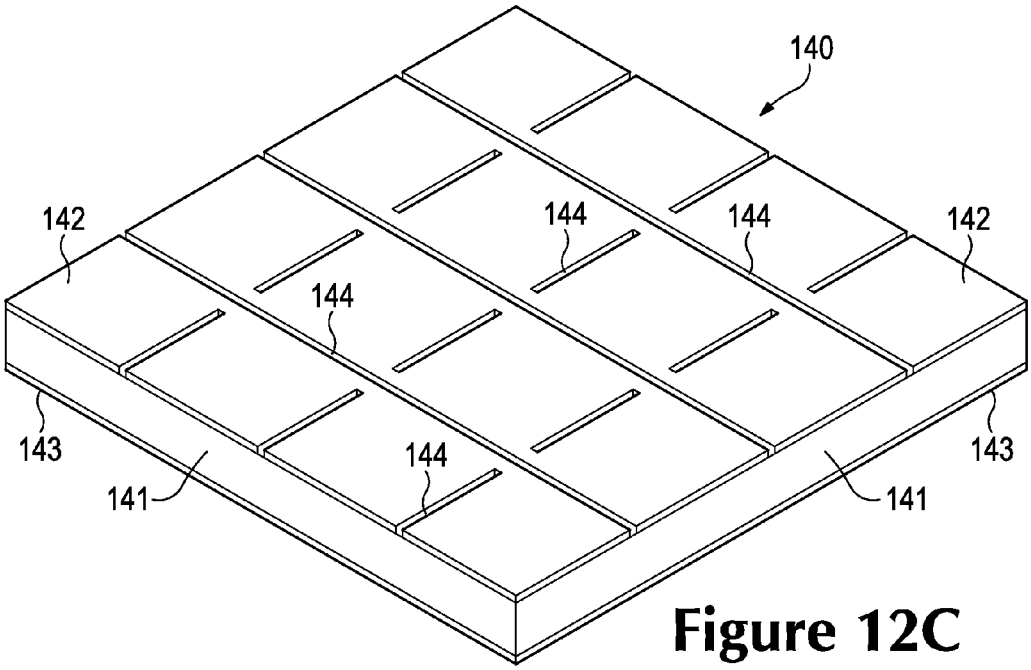

Referring again to FIG. 11, the spaces between individual sipes 144 in the various sipe lines correspond with the intersections of the sipe lines. In this configuration, exterior backing layer 142 includes various incisions or cuts at sipes 144, but is not subdivided into multiple separate components. That is, exterior backing layer 142 remains a single element, but includes various cuts or incisions at sipes 144. FIG. 12A depicts another example of a pattern in which sipes 144 exhibit a dashed or non-continuous structure, but individual sipes 144 cross each other to form x-shaped intersections in the sipe lines. In another configuration depicted in FIG. 12B, two sipes 144 are formed between each intersection in the sipe lines. Additionally, FIG. 12C depicts a hybrid configuration with continuous sipes 144 extending in one direction and sipe lines formed from dashed or non-continuous sipes 144 extending in a perpendicular direction.

Figure 12D:
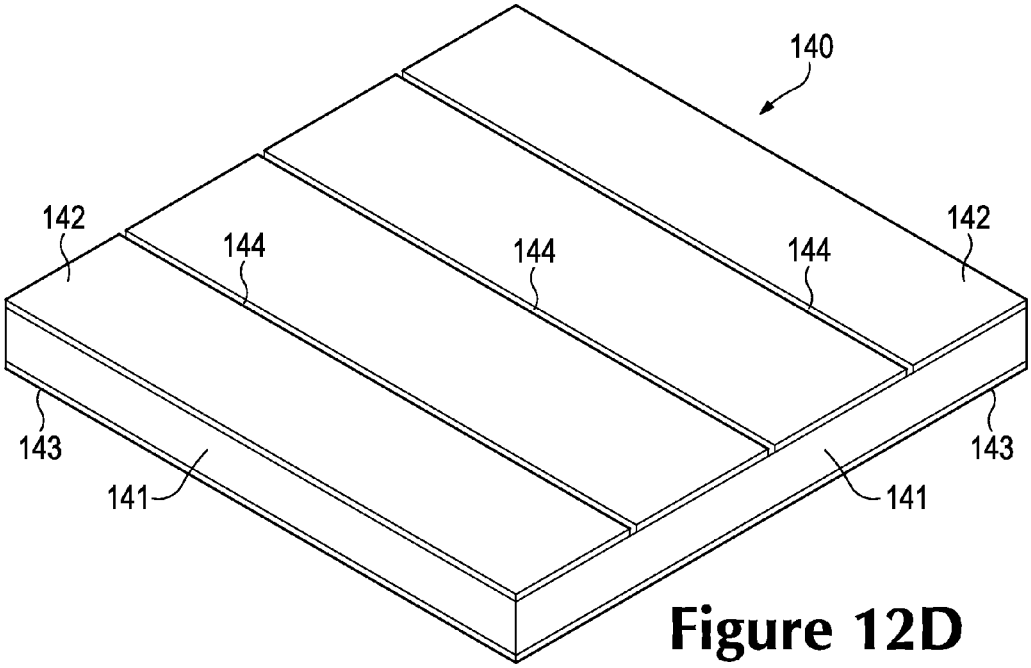
Figure 12E:
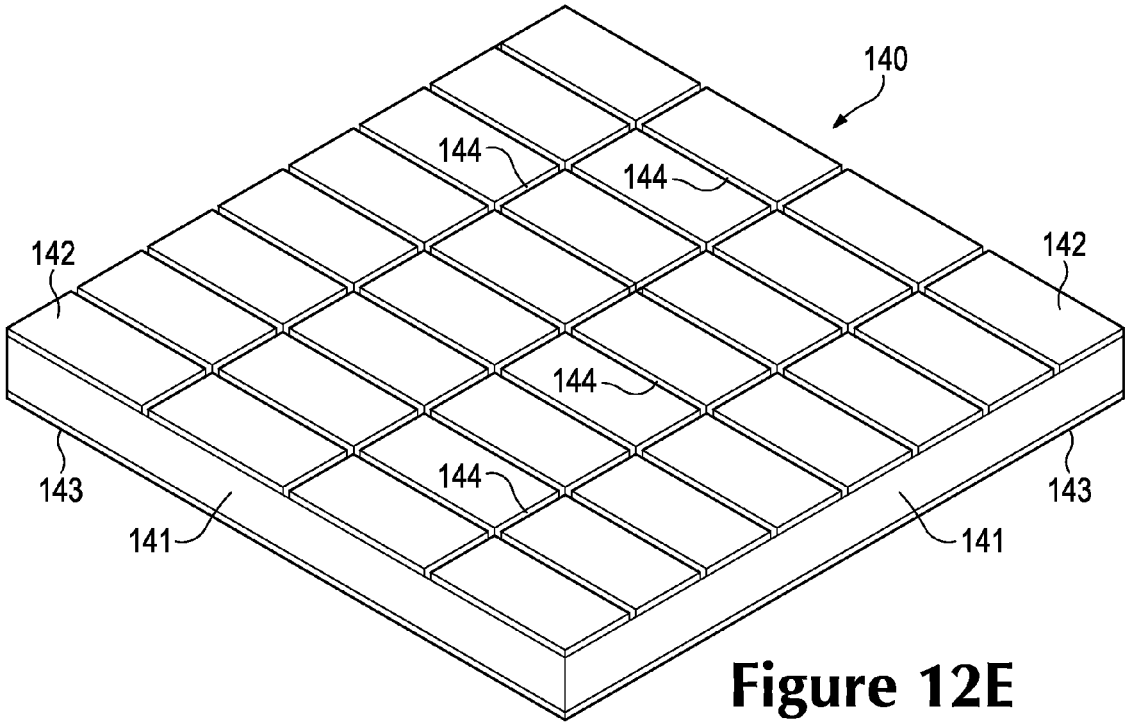
Figure 12F:
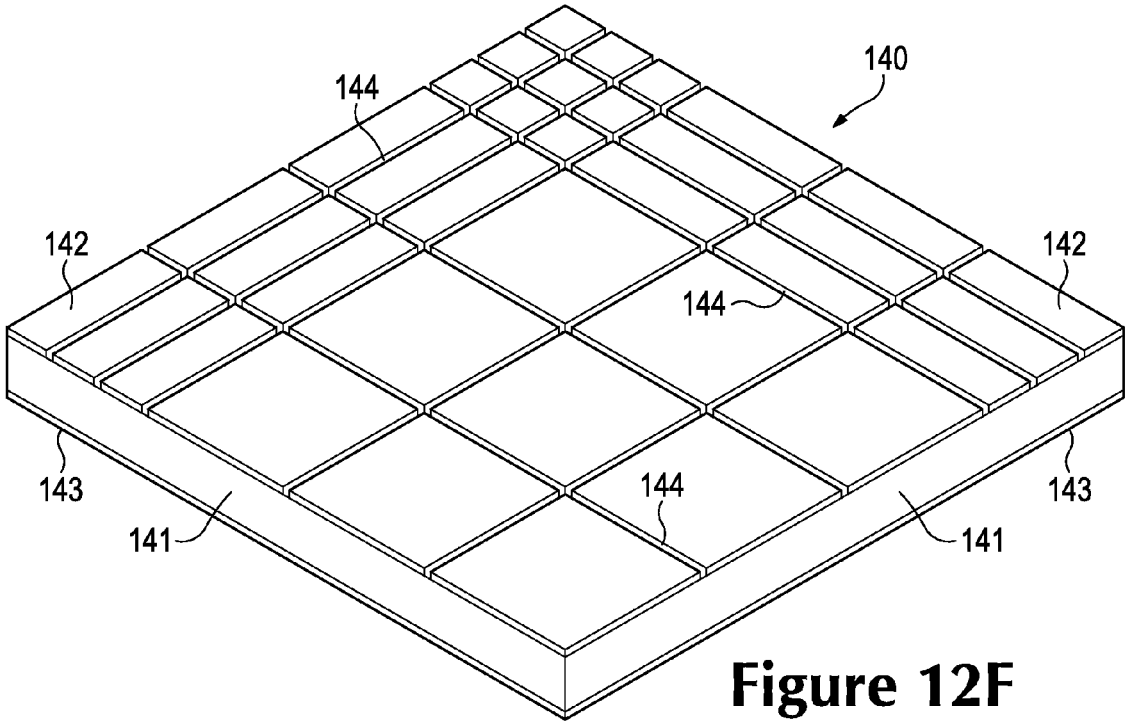
Figure 12G:
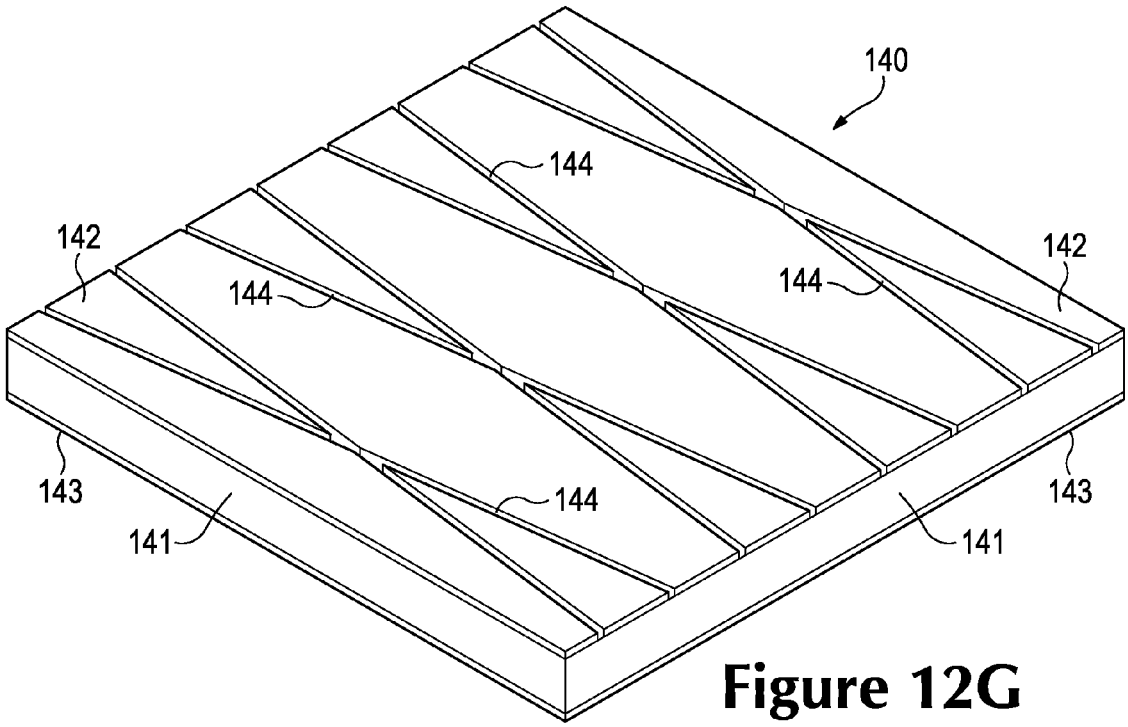
Figure 12H:
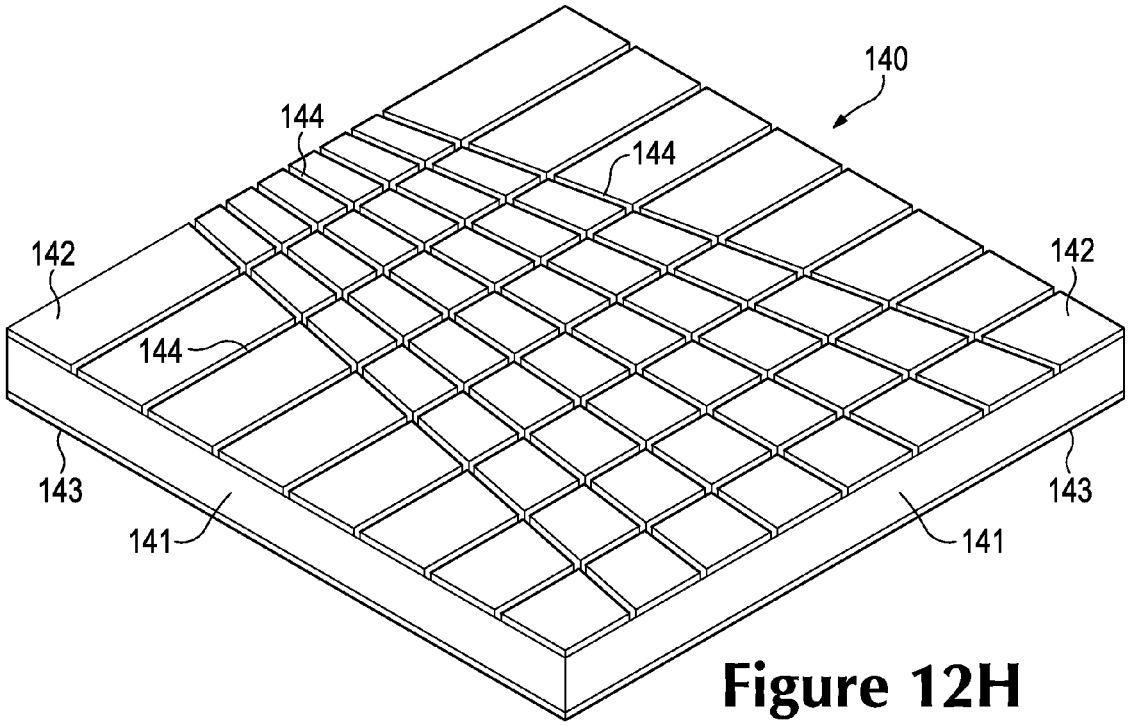
Figure 12I:
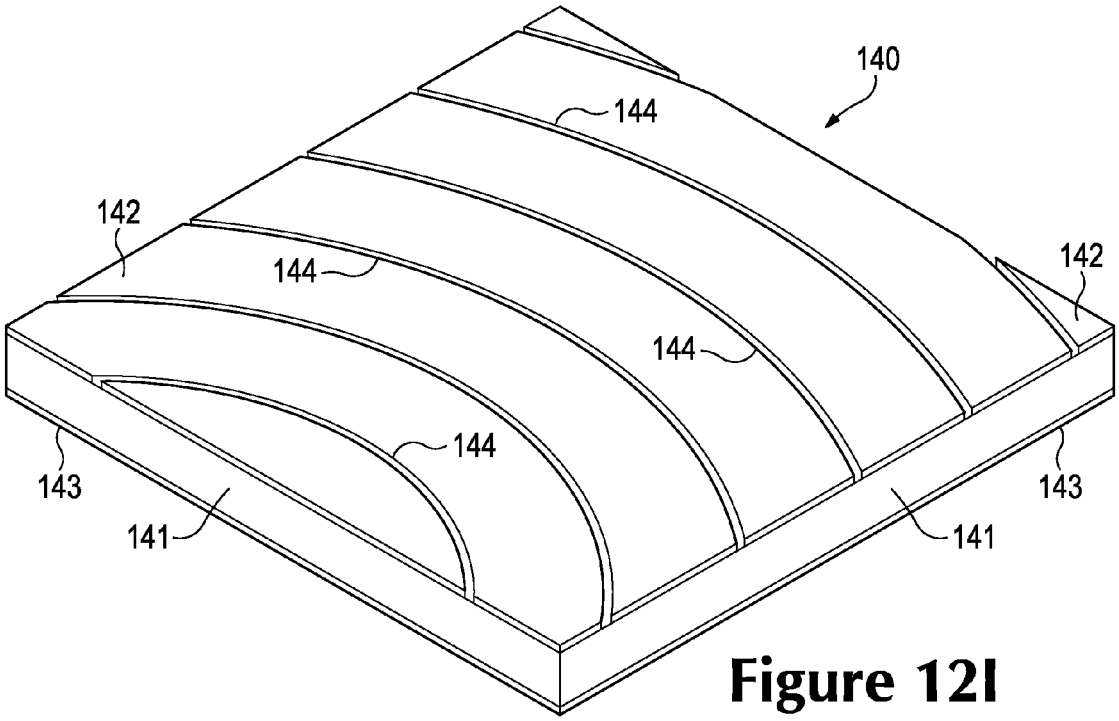
Figure 12J:
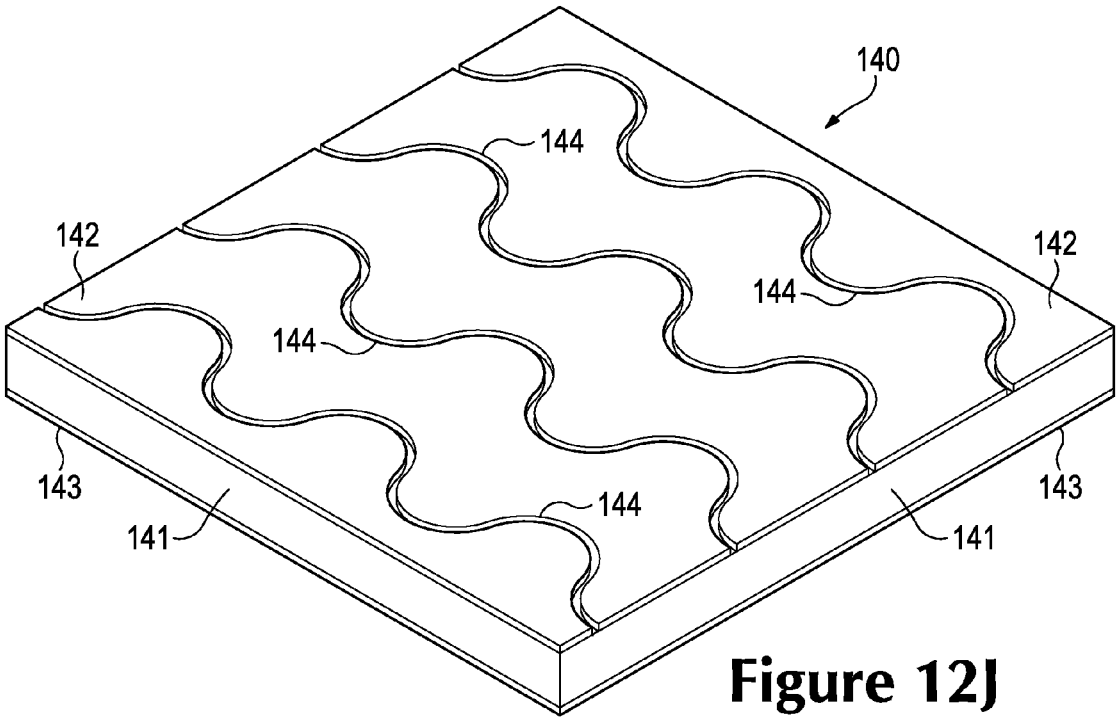
Figure 12K:
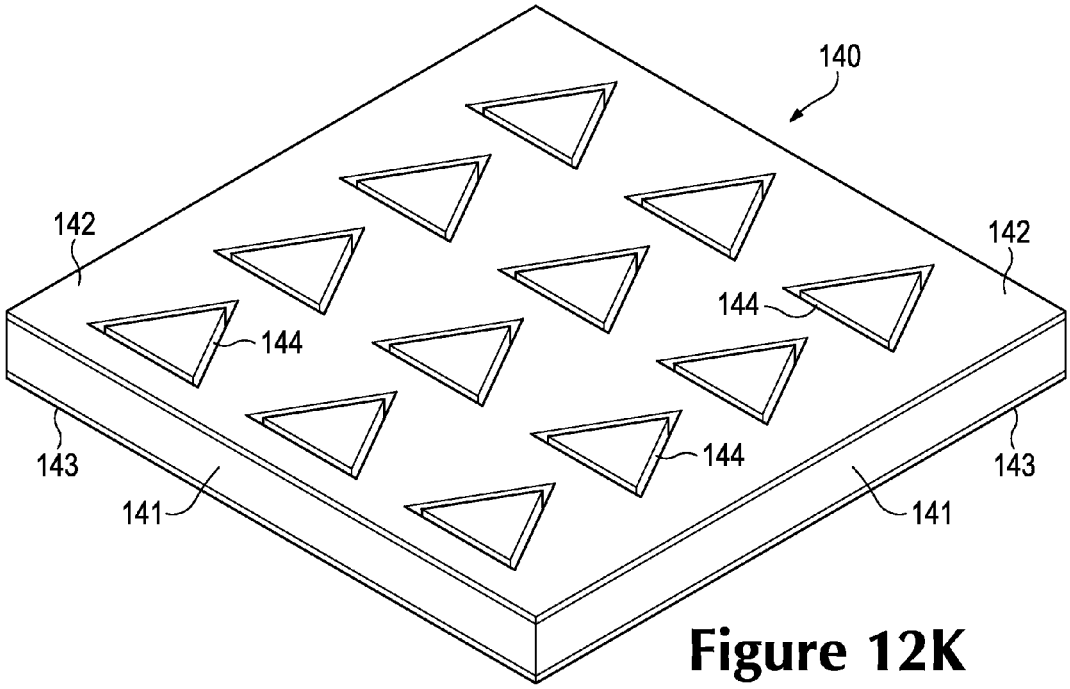
Figure 12L:
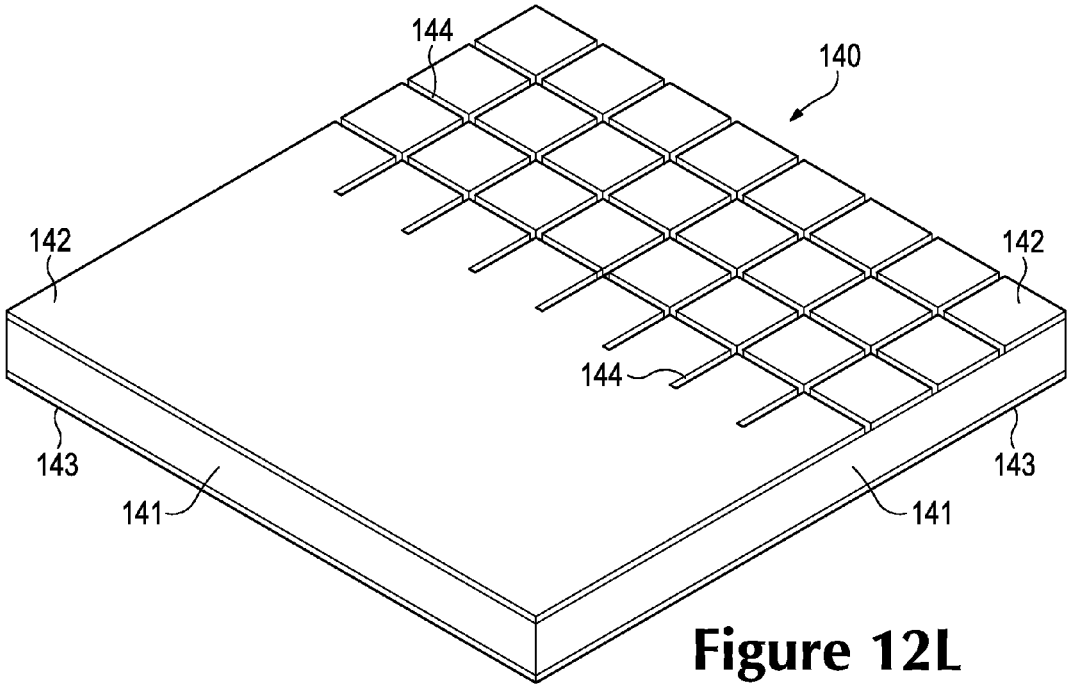

In addition to the variations discussed above, sipes 144 may vary in multiple other respects. As an example, FIG. 12D depicts sipes 144 as extending in only one direction across material element 140. Referring to FIG. 12E, sipes 144 extending in one direction are closer together and more numerous than sipes 144 extending in a perpendicular direction. Sipes 144 may also be spaced at various distances, as depicted in FIG. 12F. In another configuration, which is depicted in FIG. 12G, sipes 144 may be oriented to cross each other in a non-perpendicular manner and form diamond-shaped components of exterior backing layer 142. Referring to FIG. 12H, sipes 144 are parallel in one direction and radiate outward in a non-parallel manner in another direction. Another example of a variation is depicted in FIG. 12I, in which sipes 144 are curved or have an otherwise non-straight configuration. Similarly, FIG. 12J depicts sipes 144 as having a sinusoidal shape. In addition to being linear structures that extend across material element 140, each of sipes 144 may also be discrete and limited to particular areas of material element 140, as depicted in FIG. 12K. Additionally, as depicted in FIG. 12L, sipes 144 may only be in one area of material element 140, while being absent from another area of material element 140.

Figure 13A:
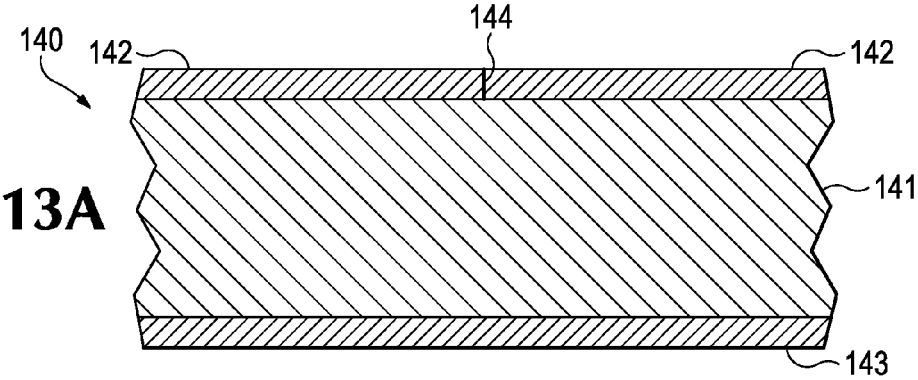
FIGS. 13A-13P are cross-sectional views corresponding with FIG. 6 and depicting further configurations of the material element from the wetsuit.
Figure 13B:
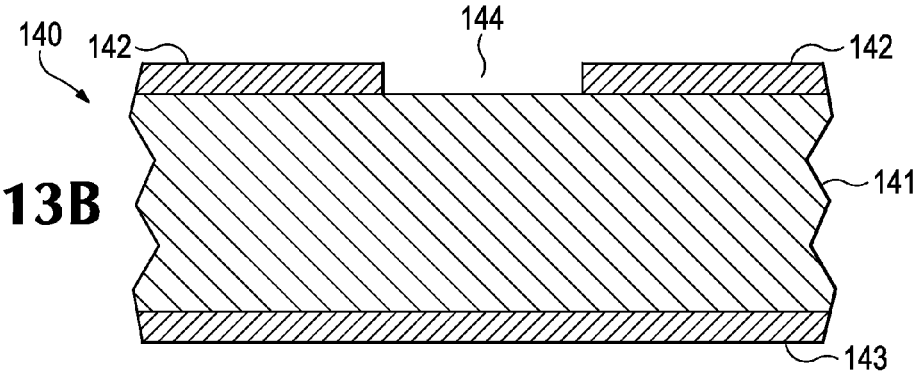
Figure 13C:
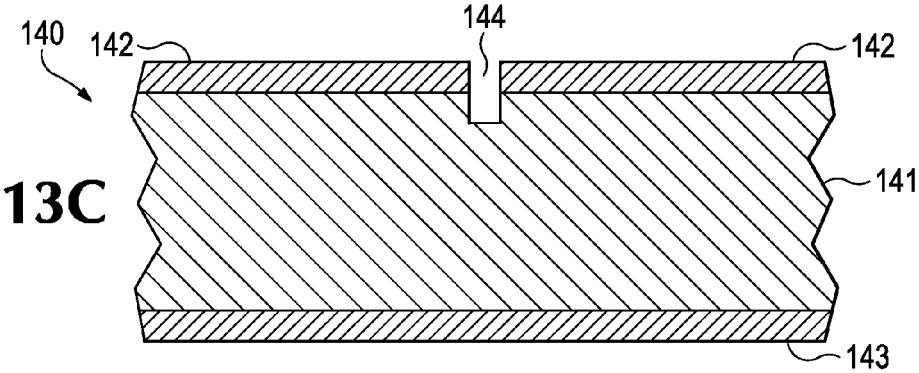
Figure 13D:
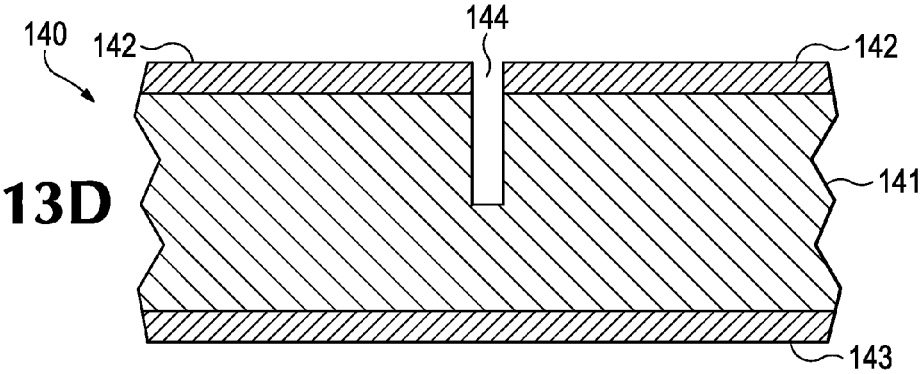
Figure 13E:
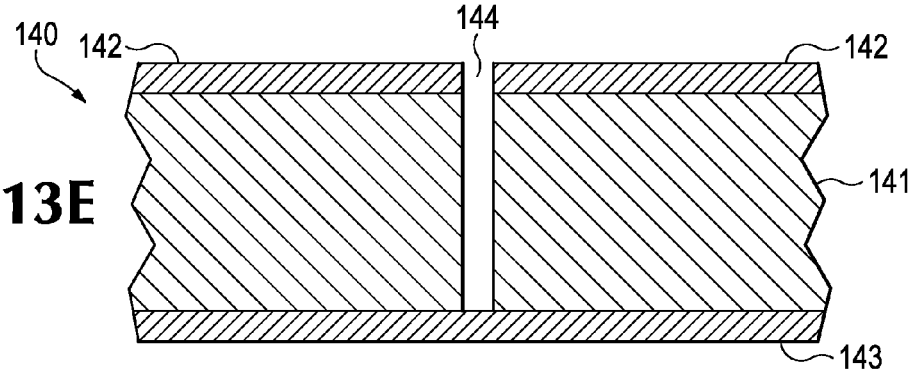
Figure 13F:
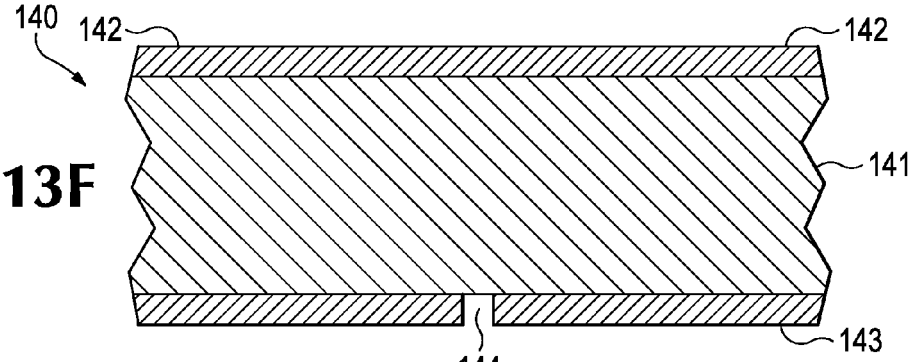
Figure 13G:
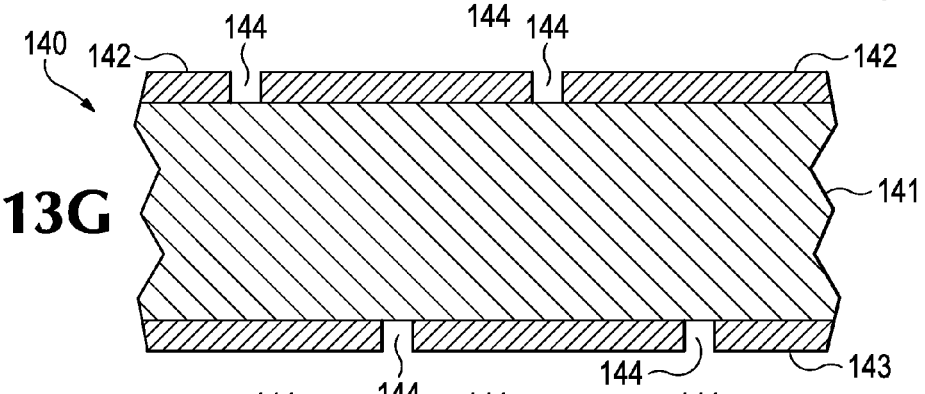
Figure 13H:
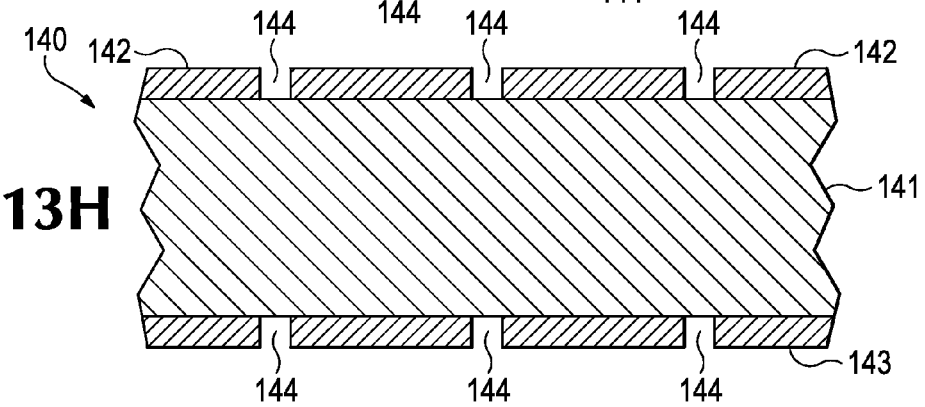

Whereas FIGS. 11 and 12A-12L depict various patterns for sipes 144, the specific structure for each sipe 144 in material element 140 may also vary considerably. Referring back to the cross-section of FIG. 6, for example, sipe 144 is depicted as a space or gap that only extends through exterior backing layer 142. Although this provides an example of a suitable structure for sipe 144, numerous variations may be utilized in areas of wetsuit 100. For example, FIG. 13A depicts sipe 144 as being only a relatively narrow incision, instead of a gap or space, in exterior backing layer 142. Sipe 144 may also have a significantly greater width, as depicted in FIG. 13B. The depth of sipes 144 may also vary. Referring to FIG. 13C, sipe 144 extends into base layer 141. A greater depth for sipe 144 is depicted in FIG. 13D. Moreover, FIG. 13E depicts a depth that extends entirely through base layer 141. In another configuration depicted in FIG. 13F, sipe 144 may be formed in interior backing layer 142, instead of exterior backing layer 142. Moreover, sipes 144 may be formed in both backing layers 142 and 143 in offset locations, as in FIG. 13G, or opposite locations, as in FIG. 13H.

Figure 13I:
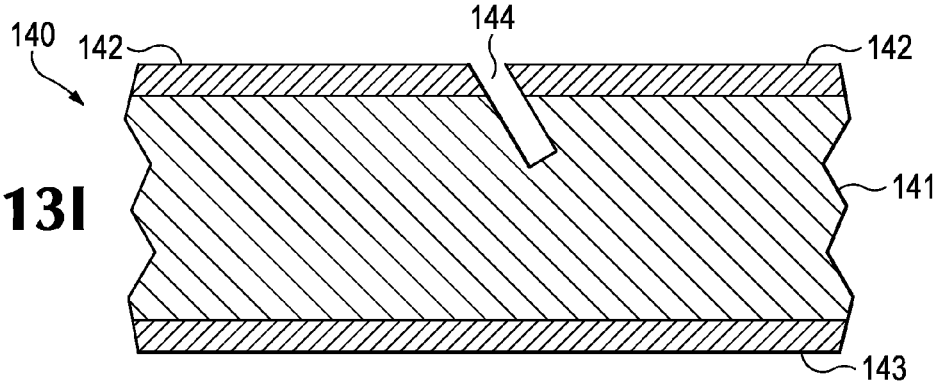
Figure 13J:
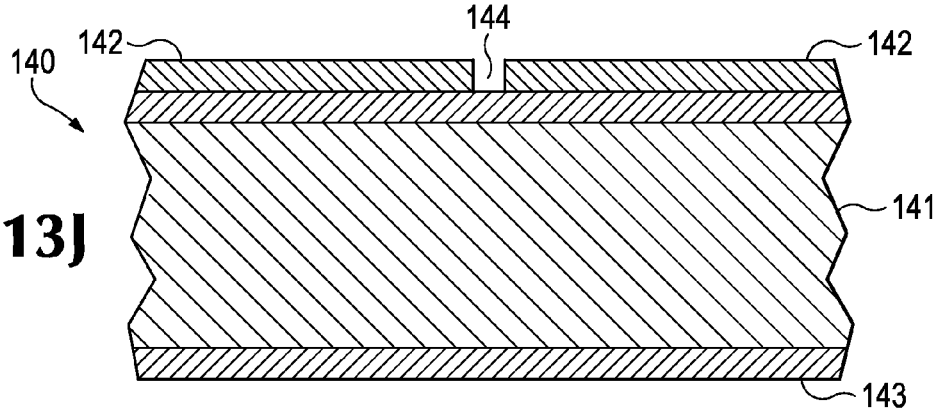
Figure 13K:
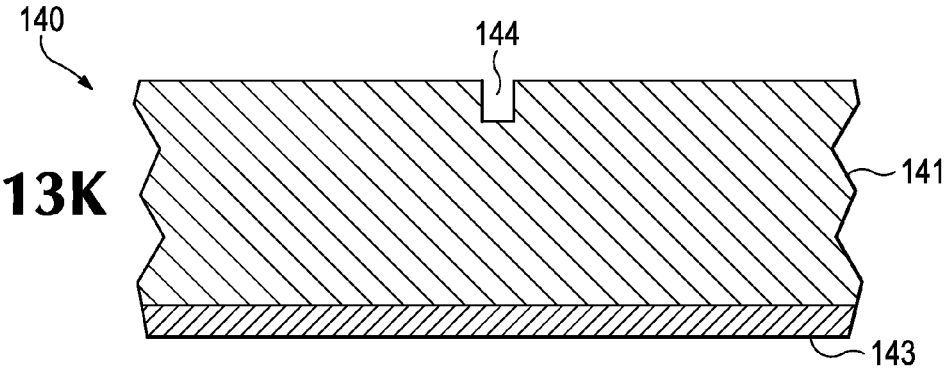
Figure 13L:
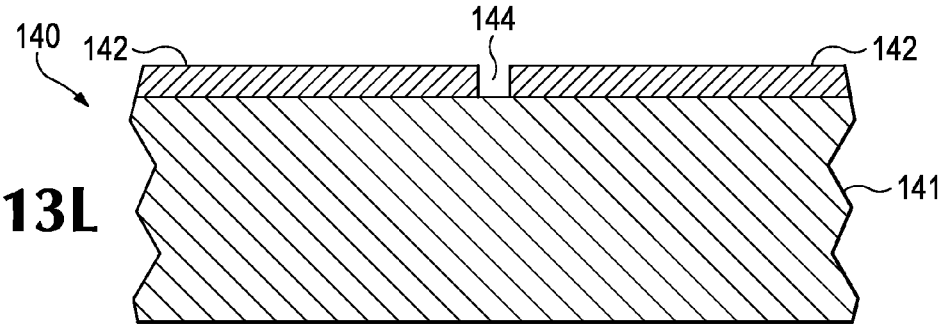
Figure 13M:
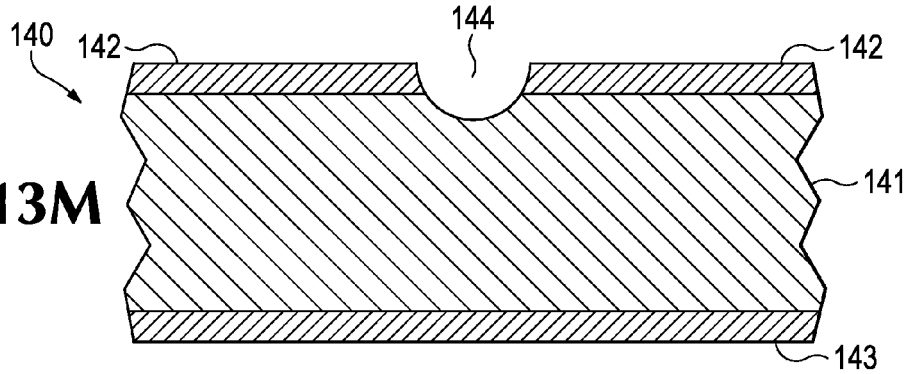
Figure 13N:
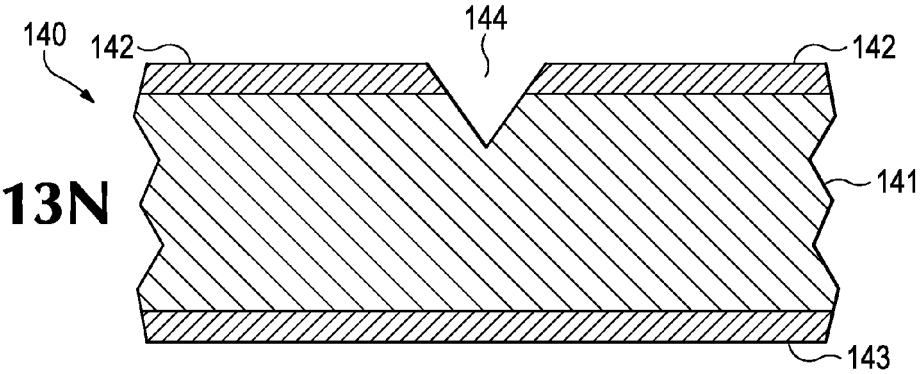
Figure 13O:
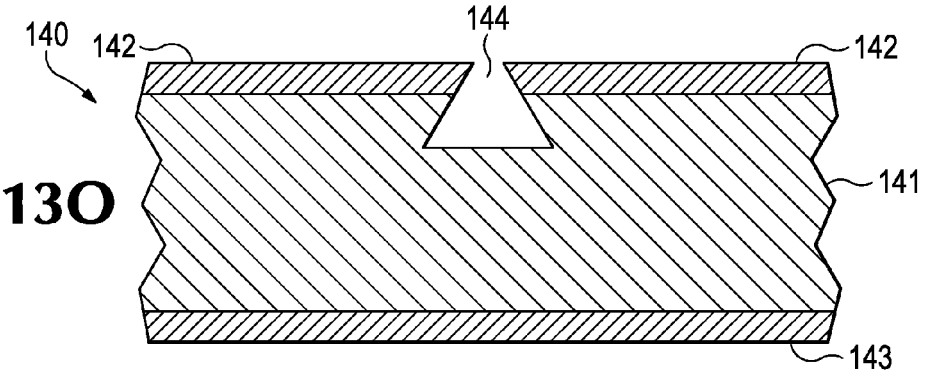
Figure 13P:
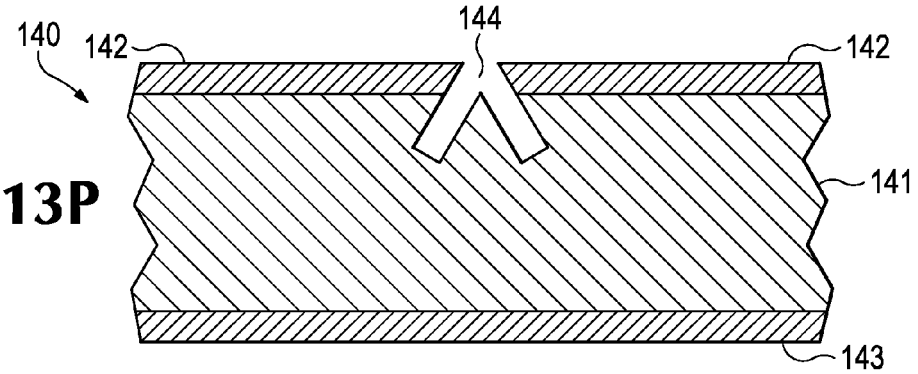

In addition to the configurations discussed above, material elements 140 and sipes 144 may vary in other aspects. Referring to FIG. 13I, sipe 144 has a diagonal orientation in material element 140. FIG. 13J illustrates a configuration wherein exterior backing layer 142 has a two-strata configuration and sipe 144 extends only through one stratum. Additionally, FIGS. 13K an 13L depict configurations of material element 140 in which one of backing layers 142 and 143 are absent. Although sipes 144 may have a squared shape, sipes 144 may have rounded, triangular, or dovetail shapes, for example, as depicted in FIGS. 13M-13O. Sipes 144 may also have a bifurcated aspect, as depicted in FIG. 13P.

The above discussion presents numerous variations for material elements 140, including sipes 144. While each of these variations may be utilized individually, combinations of these variations may be utilized to further enhance the stretch, flex, and aesthetic properties of wetsuit 100. Moreover, these variations may be utilized in different portions of wetsuit 100, material elements 140, and areas of individual material elements 140 to vary the stretch, flex, and aesthetic properties throughout wetsuit 100.

Figure 14:
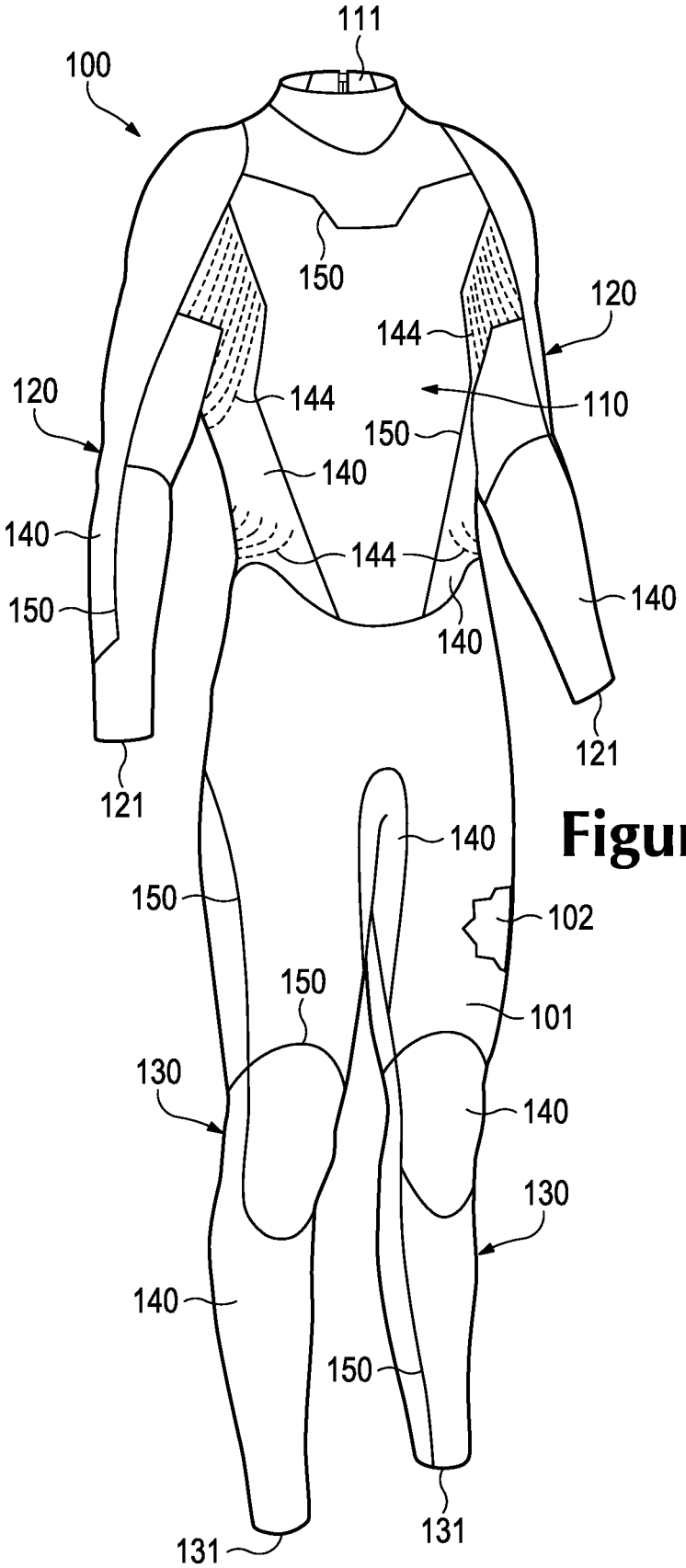
FIGS. 14 and 15 are perspective views of another configuration of the wetsuit.
Figure 15:
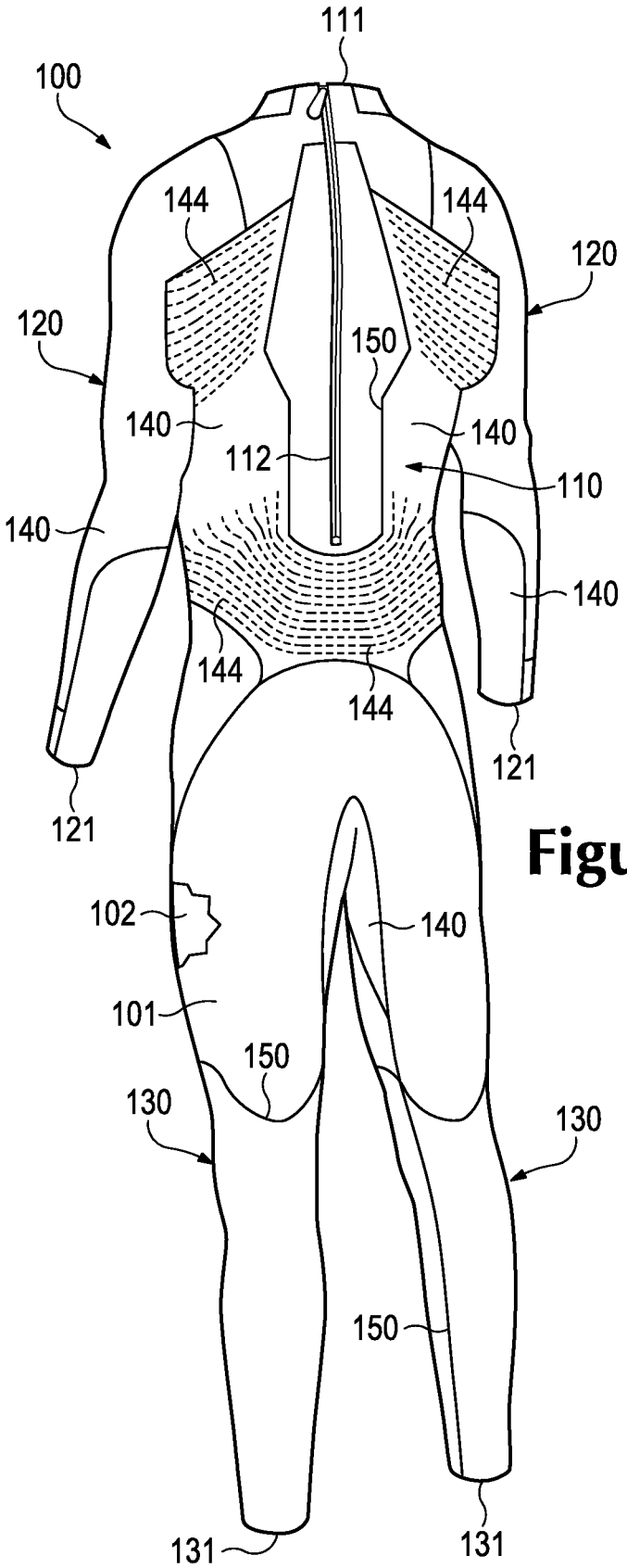
Figure 16:
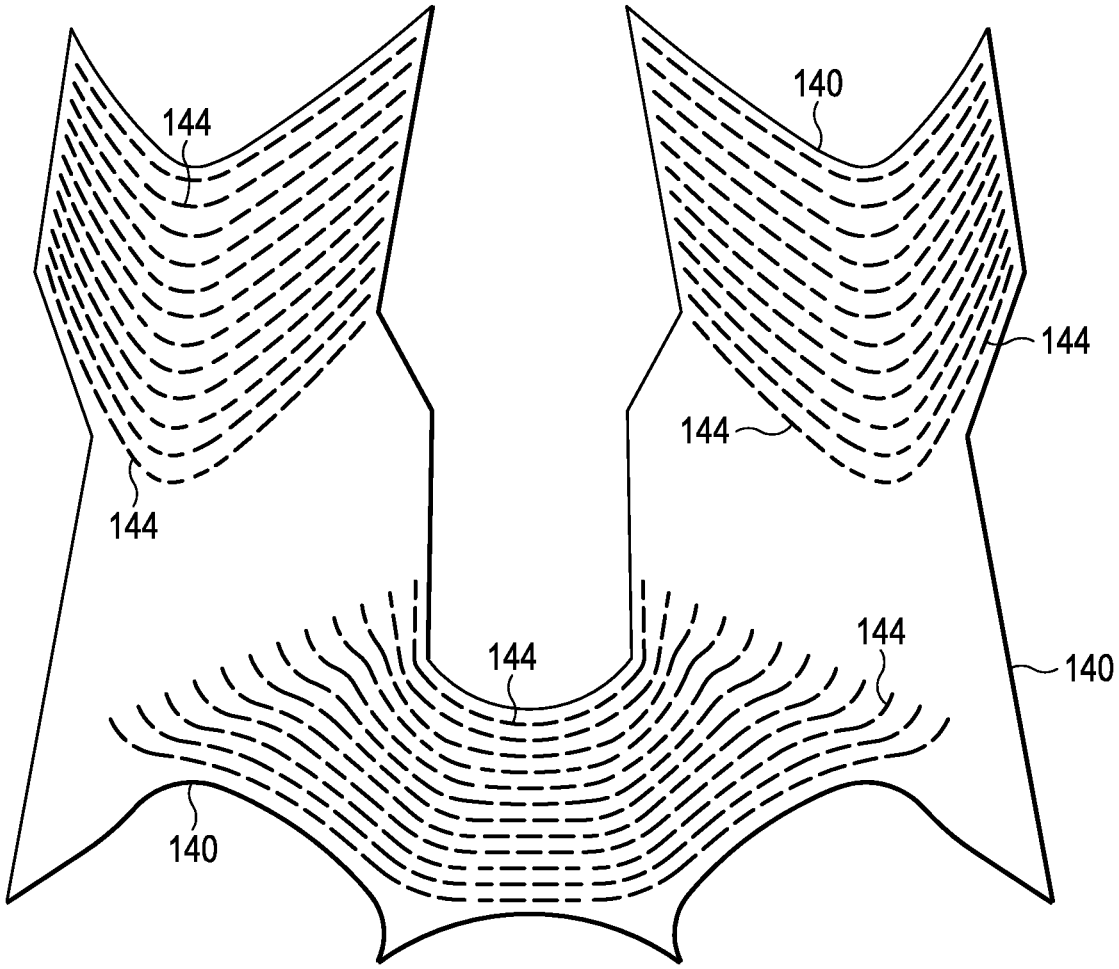
FIG. 16 is a plan view of a material element from the wetsuit in FIGS. 14 and 15.

Another version of wetsuit 100 is depicted in FIGS. 14 and 15 as having many of the features discussed above. Sipes 144 are positioned primarily in torso region 110 and upper areas of arm regions 120, which may enhance the stretch and flex properties of wetsuit 100 in these areas. Moreover, each of sipes 144 are formed in one of material elements 140, which is depicted individually in FIG. 16. This material element 140 forms a portion of the back area of torso region 110, extends around to side areas of torso region 110, and forms a portion of arm regions 120. Sipes 144 exhibit the dashed and non-continuous aspect discussed above and form generally parallel and curved sipe lines. Additionally, sipes 144 are not present in every area of material element 140, but are primarily formed in three separate areas of material element 140. That is, sipes 144 are limited to specific areas of material element 140, rather than extending throughout material element 140. In these respects, FIG. 16 depicts a configuration that incorporates some of the features discussed previously in FIGS. 11, 12D, 12I, and 12L, for example. As such, FIGS. 14-16 provide an illustration of the manner in which multiple variations may be utilized in combination.

Wetsuit Manufacturing

Wetsuit 100 may be formed through any of various manufacturing processes. In general, however, material elements 140 are formed and cut to their appropriate shapes and sizes, and then material elements 140 are joined at seams 150 through one or more of adhesive bonding, thermal bonding, taping, and stitching (e.g., blind stitching). Many aspects of the manufacturing processes are commonly utilized in producing wetsuits, including (a) forming material elements with base layers and backing layers and (b) joining the material elements. As such, the following discussion will illustrate aspects of the manufacturing processes that relate to forming material elements 140 with sipes 144.

Figure 17A:
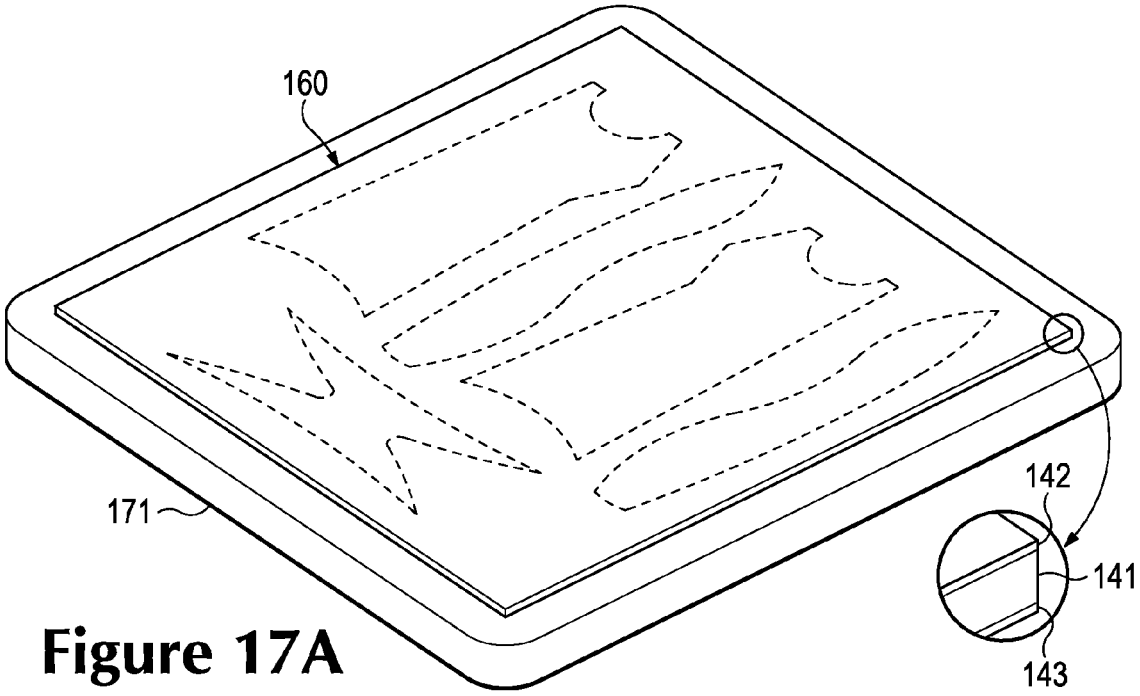
FIGS. 17A-17E are schematic perspective views of a manufacturing process for material elements of the wetsuit.

In the configurations of wetsuit 100 depicted in FIGS. 1 and 2 and FIGS. 9 and 10, sipes 144 exhibit a regular pattern that extends throughout various material elements 140. That is, the pattern of sipes 144 remains substantially constant in different areas of a particular material element 140, and sipes 144 extend between opposite edges of the material element 140 without significant variation in different areas. In order to form material element 140 to exhibit these features, a blank 160 is initially placed upon a platen 171 or another surface, as depicted in FIG. 17A. Blank 160 is a large piece of material (e.g., 1-5 square meters) that may be utilized to form multiple material elements 140. As such, blank 160 includes base layer 141 and both backing layers 142 and 143. For purposes of reference, dashed lines are shown on blank 160 to illustrate the positions of various material elements 140 that will be formed later in the manufacturing process.

Figure 17B:
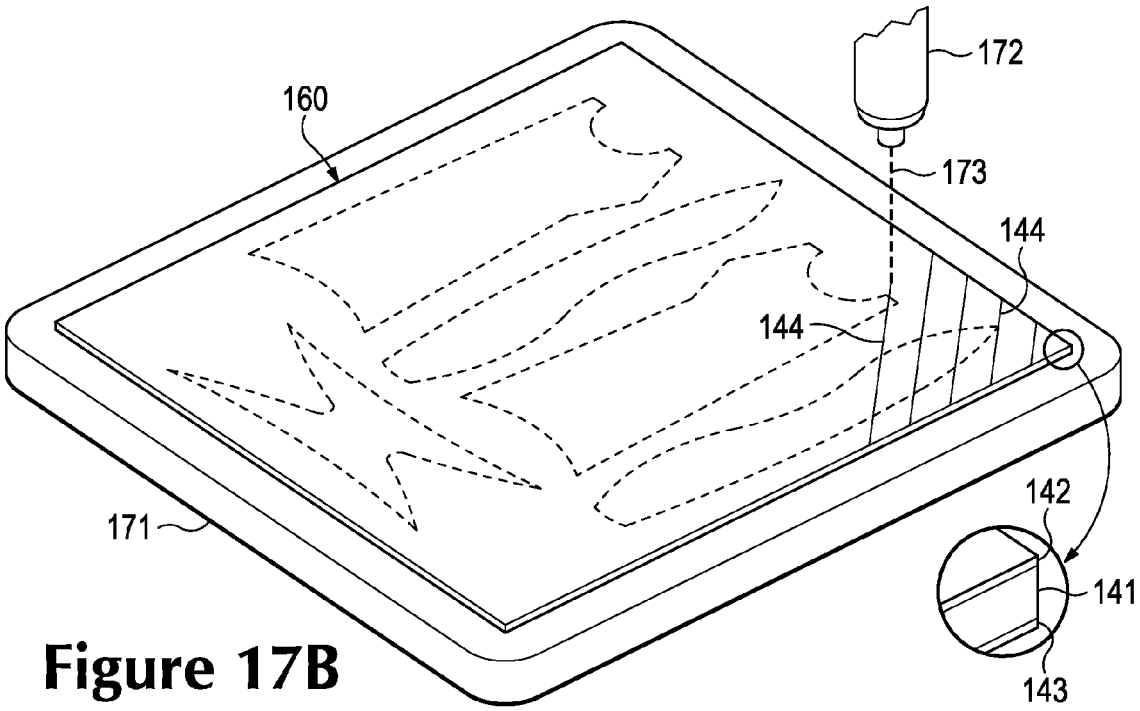

Once blank 160 is positioned, a laser apparatus 172 may initiate the formation of sipes 144 in blank 160, as depicted in FIG. 17B. Laser apparatus 172 produces a beam 173 with the capacity to form sipes 144. Beam 173 heats selected areas of blank 160 and forms sipes 144 by burning, incinerating, or otherwise ablating portions of exterior backing layer 142. More particularly, laser apparatus 172 may form sipes 144 in a manner that extends through exterior backing layer 142 without significantly extending into base layer 141, unless sipes 144 of greater depth are desired. In order to prevent other areas of blank 160 from unintentionally burning, sipes 144 may be formed in the presence of a non-combustible fluid, such as carbon dioxide or nitrogen.

Laser apparatus 172 may include an emitter for beam 173 that moves relative to blank 160 and forms sipes 144 in exterior backing layer 142. That is, the positions of sipes 144 may be controlled by movements of laser apparatus 172 relative to blank 160. Alternately, beam 173 may reflect off of one or more movable or pivotable mirrors, and the positions of sipes 144 may be controlled by movements of the mirrors. Factors that determine the depth and width of an individual sipe 144 include the power output of laser apparatus 172, the focus of beam 173, the velocity of beam 173 relative to blank 160, the specific materials forming exterior backing layer 142, and the thickness of exterior backing layer 142. An example of a suitable laser apparatus 172 is any of the conventional $CO_2$ or Nd:YAG lasers.

Figure 17C:
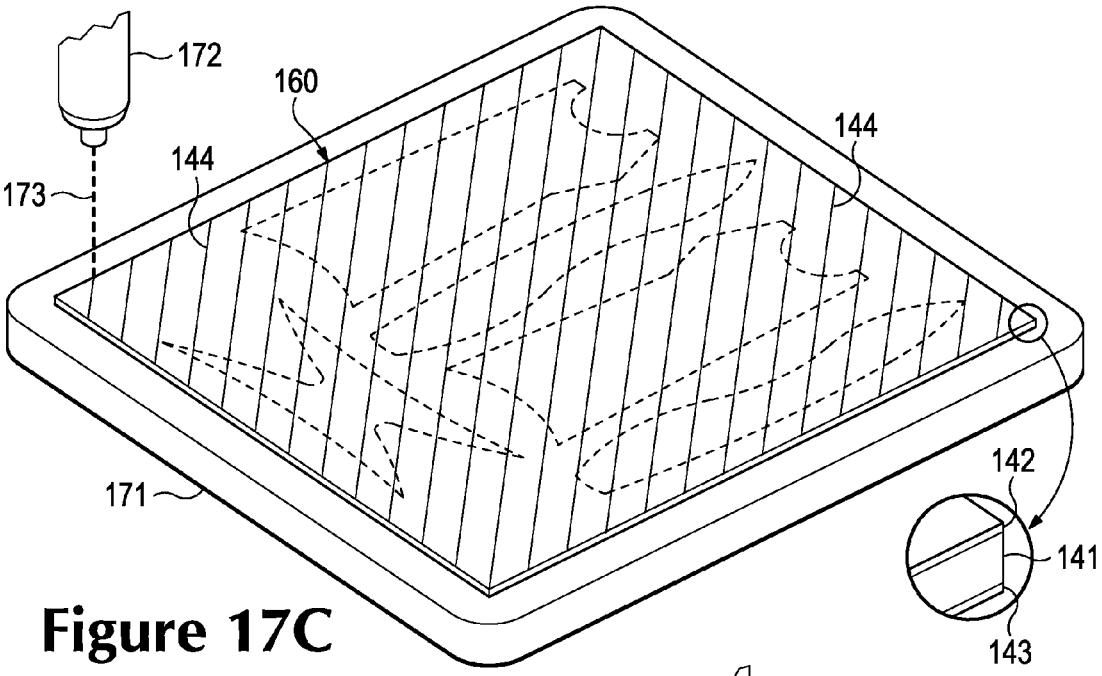
Figure 17D:
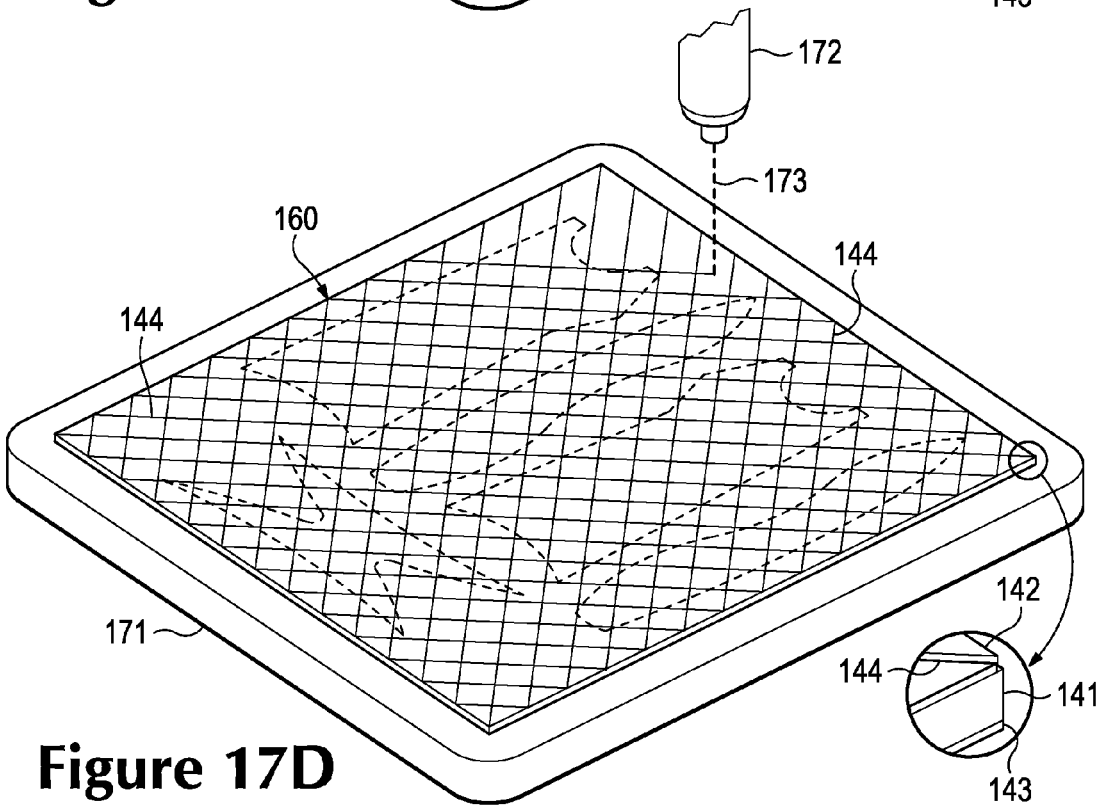

As laser apparatus 172 continues, various parallel sipes 144 extend throughout blank 160 and through the dashed areas illustrating the positions of various material elements 140, as depicted in FIG. 17C. Laser apparatus 172 then moves beam 173 relative to blank 160 to form sipes 144 extending in a perpendicular direction, as depicted in FIG. 17D. In this manner, sipes 144 having the configuration depicted in FIGS. 1 and 2 are formed. A similar process may be utilized to form the sipes 144 with any other configuration, including many of the configurations for sipes 144 disclosed above.

Figure 17E:
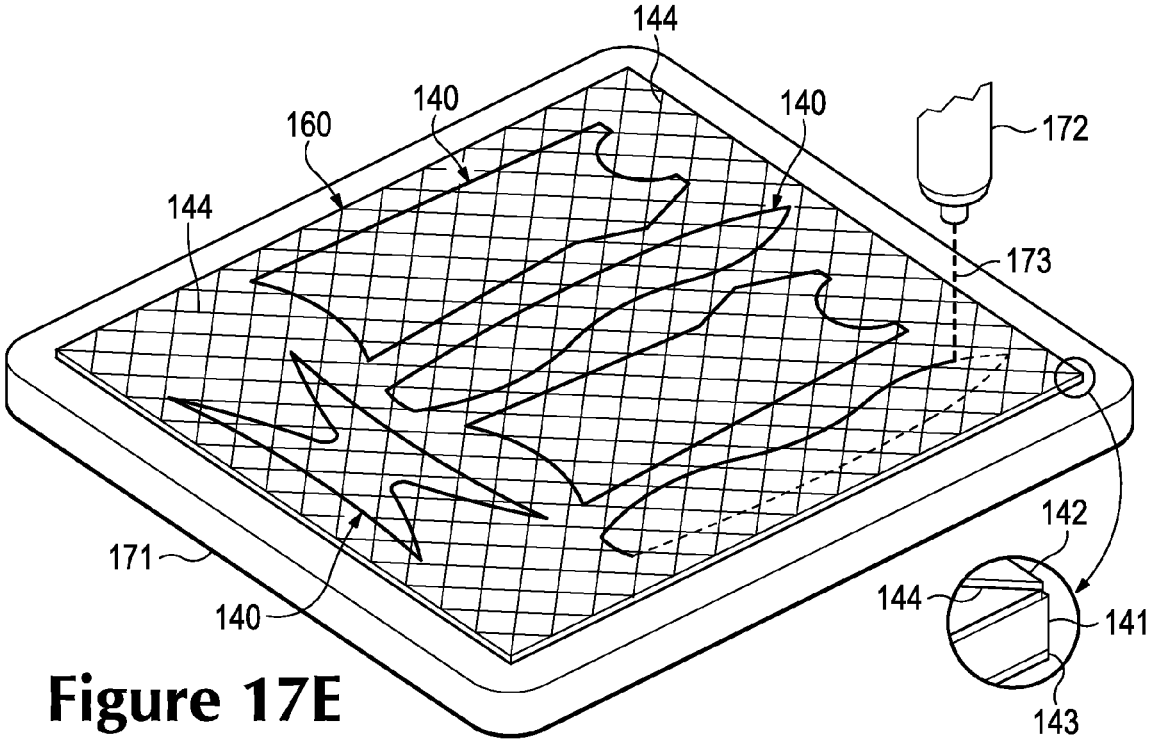

At this stage of the manufacturing process, sipes 144 extend throughout blank 160. Moreover, sipes 144 exhibit a regular pattern that extends throughout the areas of blank 160 that will form each of material elements 140. As a final step in the manufacturing process for material elements 140, laser apparatus 172 may direct beam 173 to cut or otherwise separate the various material elements 140 from blank 160, as depicted in FIG. 17E. That is, beam 173 may increase in power, for example, to extend through each of layers 141-143, thereby shaping the various material elements 140 from blank 160.

The use of laser apparatus 172 provides an example of a method for forming sipes 144 and shaping material elements 140. A variety of other processes may also be utilized. For example, sipes 144 may be formed by (a) a blade that forms a shallow incision in exterior backing layers 142, (b) a router that cuts grooves in exterior backing layer 142, (c) a hydro-cutting apparatus that directs a focused stream of water or another liquid into blank 160, or (d) a die-cutting apparatus that compresses and cuts areas of exterior backing layers 142, for example. Moreover, these processes may also be utilized to shape the various material elements 140 from blank 160. In some manufacturing processes, a variety of different methods may be utilized to form sipes 144 and shape material elements 140.

The above discussion presents an example of a manufacturing process that forms sipes 144 to exhibit a regular pattern that extends throughout various material elements 140. Some material elements 140, such as the configuration of FIG. 16, include sipes 144 without a regular pattern or with variations in different areas. Given the variation in these material elements, a different manufacturing process may be utilized, as discussed below.

Figure 18A:
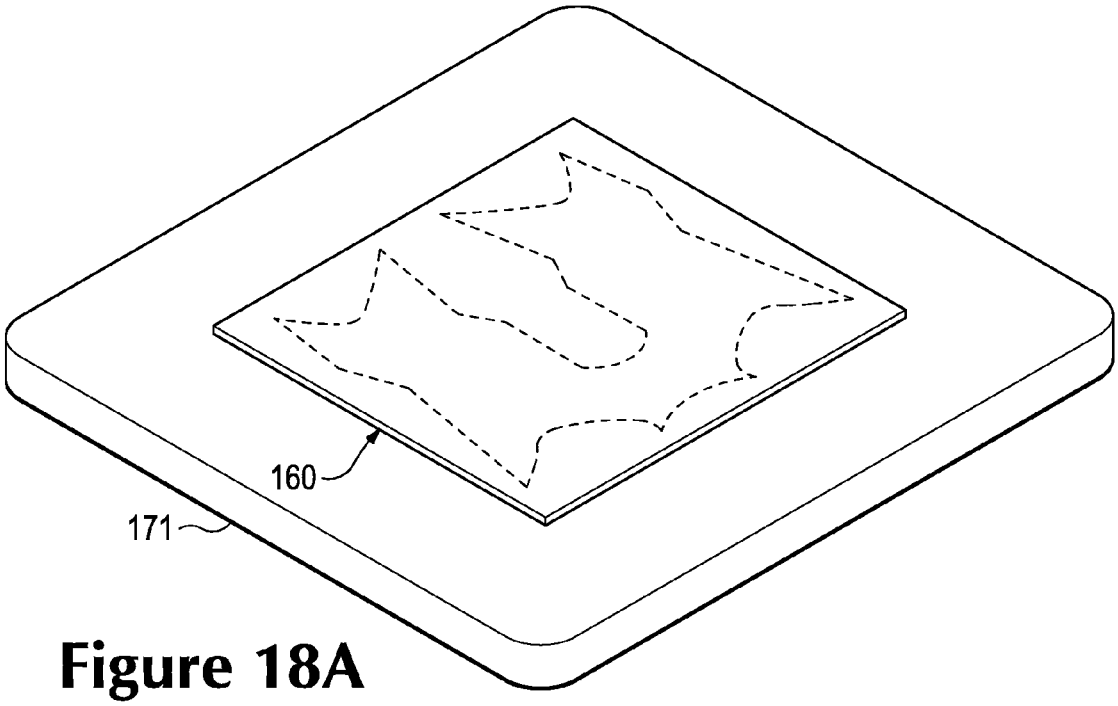
FIGS. 18A-18D are schematic perspective views of another manufacturing process for material elements of the wetsuit.
Figure 18B:
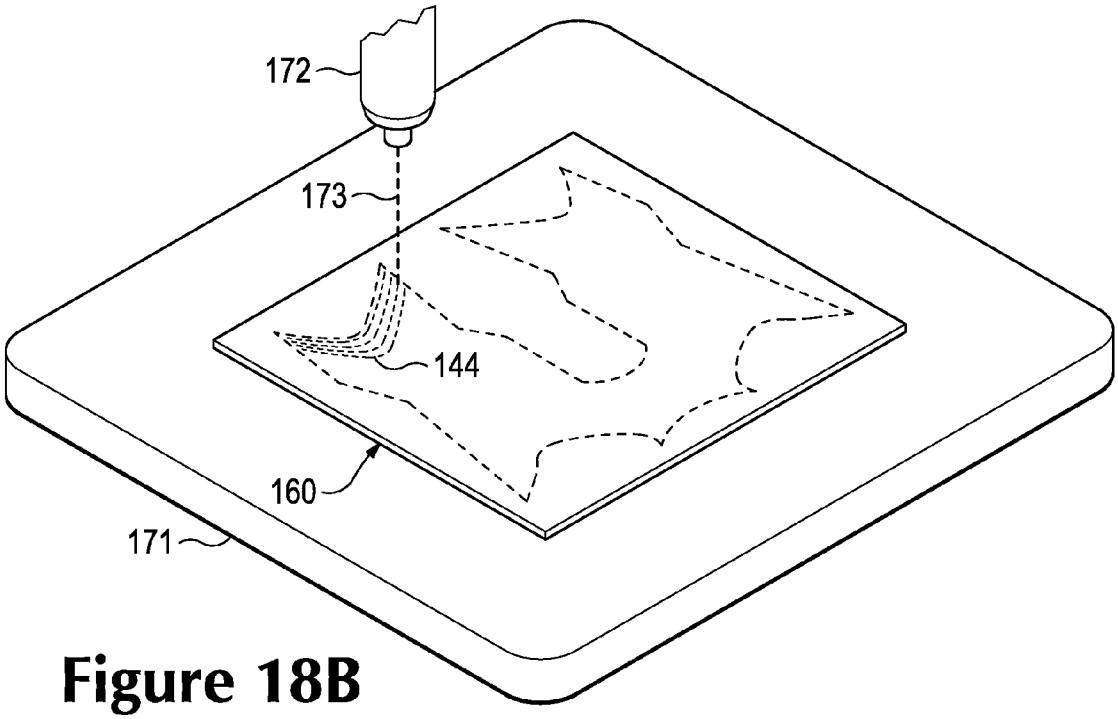
Figure 18C:
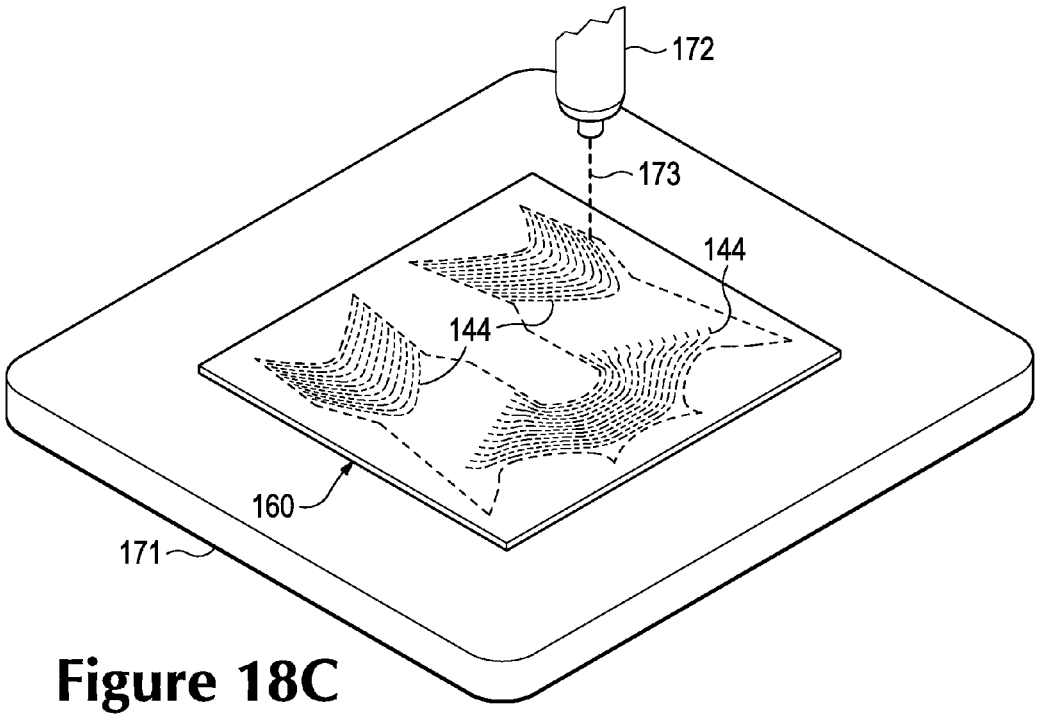
Figure 18D:
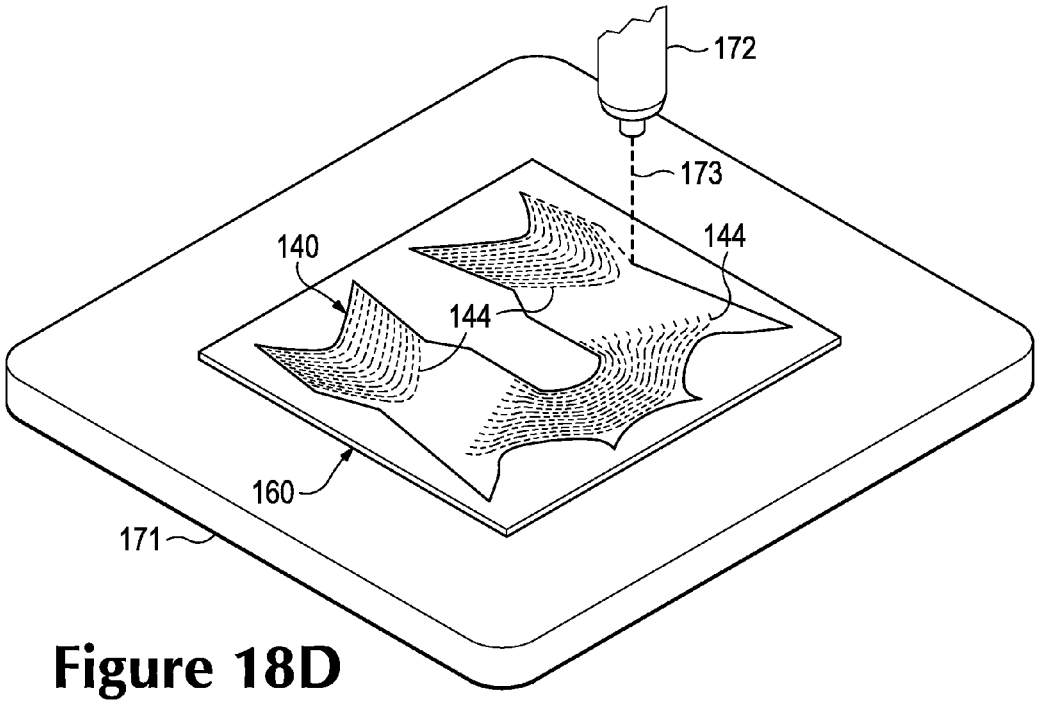

In order to form a material element 140 having the configuration of FIG. 16, a blank 160 with the general size of material element 140 may be located on platen 171, as depicted in FIG. 18A. For purposes of reference, dashed lines are shown on blank 160 to illustrate the position of material element 140, which will be formed later in the manufacturing process. Laser apparatus 172 then initiates the formation of sipes 144, as depicted in FIG. 18B, by directing beam 173 to burn, incinerate, or otherwise ablate portions of exterior backing layer 142. Once sipes 144 are formed, as depicted in FIG. 18C, laser apparatus 172 may cut material element 140 from blank 160, as depicted in FIG. 18D. That is, beam 173 may increase in power, for example, to extend through each of layers 141-143, thereby shaping material element 140 from blank 160. As with the discussion above, other methods (e.g., blade, router, hydro-cutting apparatus, die-cutting apparatus) may be utilized to form sipes 144 and shape material elements 140. In some manufacturing processes, material element 140 may also be cut from blank 160 prior to the formation of sipes 144.

In the manufacturing processes discussed above, backing layers 142 and 143 are joined to base layer 141 prior to forming sipes 144. In other processes, however, sipes 144 may be formed in exterior backing layer 142 prior to joining exterior backing layer 142 with base layer 141. That is, a laser-cutting apparatus, blade, router, hydro-cutting apparatus, or die-cutting apparatus, for example, may be utilized to impart incisions, cuts, spaces, or other features that form sipes 144 in exterior backing layer 142, and then exterior backing layer 142 may be joined to base layer 141. Additionally, sipes 144 may be formed by joining two spaced and separate elements of exterior backing layer 142 with base layer 141. Similarly, sipes 144 may be formed in interior backing layer 143 or both of backing layers 142 and 143 prior to joining with base layer 141. Accordingly, various processes may be utilized to form sipes 144.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A wetsuit for aquatic activities, the wetsuit comprising:

a base layer formed from a thermal insulation material, the base layer having a first surface and an opposite second surface; and a first backing layer contiguous with and secured to the first surface of the base layer, the first backing layer forming at least a portion of an exterior surface of the wetsuit, having less stretch than the base layer and including a first sipe and a second sipe both extending through the first backing layer, the second sipe being spaced from the first sipe, and wherein the base layer has an even thickness from a first location adjacent to the first sipe to a second location that is adjacent to the second sipe.

2. The wetsuit recited in claim 1, wherein the sipes are substantially straight.

3. The wetsuit recited in claim 1, wherein the first sire and the second sire both extend through all of the way through a thickness of the first backing layer.

4. The wetsuit recited in claim 1, further including a second backing layer contiguous with and secured to the second surface of the base layer such that the first backing layer and the second backing layer sandwich the base layer, the second backing layer including a third sipe and a fourth sipe spaced from the third sipe, wherein the third sipe is aligned with the first sipe and the fourth sipe is aligned with the second sipe.

5. The wetsuit recited in claim 1, wherein the first backing layer includes a third sipe that is spaced from the second sipe, wherein the thickness of the base layer is constant from the second location adjacent the second sipe to a third location that is adjacent the third sipe.

6. The wetsuit recited in claim 1, wherein the first sipe is one sipe of a first plurality of sipes together forming a first discontinuous line and the second sipe is one sipe of a second plurality of sipes forming a second discontinuous line, the first plurality of sipes in the first discontinuous line being aligned with and spaced from each other, and the second plurality of sipes in the second discontinuous line being aligned with and spaced from each other.

7. The wetsuit recited in claim 6, wherein the first discontinuous line is parallel to the second discontinuous line.

8. The wetsuit recited in claim 1, wherein the thermal insulation material of the base layer is polymer foam.

9. The wetsuit recited in claim 1, wherein the thermal insulation material of the base layer is neoprene.

10. A wetsuit for aquatic activities, the wetsuit comprising:

a polymer foam layer having a first surface and an opposite second surface;

a first backing layer secured to the first surface of the polymer foam layer and forming at least a portion of an exterior surface of the wetsuit, wherein the first backing layer defines a first sipe and a second sipe spaced from the first sipe and wherein the first sipe and the second sipe both expose a portion of the polymer foam layer; and a second backing layer secured to the second surface of the polymer foam layer and forming at least a portion of an interior surface of the wetsuit, wherein the second backing layer defines a third sipe and a fourth sipe spaced from the third sipe and wherein the third sipe of the second backing layer is aligned with the first sipe of the first backing layer and the fourth sipe of the second backing layer is aligned with the second sipe of the first backing layer.

11. The wetsuit recited in claim 10, wherein the first sine, second sire, third sire, and fourth sire are substantially straight.

12. The wetsuit recited in claim 10, wherein the first sire, second sire, third sire, and fourth sire are curved.

13. The wetsuit recited in claim 10, wherein the first sipe is one of a first plurality of sipes aligned to form a discontinuous line.

14. The wetsuit recited in claim 13, wherein the second sipe is one of a second plurality of sipes aligned to form a discontinuous line.

15. The wetsuit recited in claim 14, wherein the first plurality of sipes are parallel to the second plurality of sipes.

16. The wetsuit recited in claim 13, wherein the first plurality of sipes are located in arm regions of the wetsuit.

17. The wetsuit recited in claim 13, wherein the first plurality of sipes are located in a torso region of the wetsuit.

18. The wetsuit recited in claim 13, wherein the first plurality of sipes are located in side areas of a torso region of the wetsuit.

19. The wetsuit recited in claim 13, wherein the first plurality of sipes are located in leg regions of the wetsuit.

20. The wetsuit recited in claim 13, wherein the first plurality of sipes are located in (a) arm regions of the wetsuit, (b) an upper area of a torso region of the wetsuit, and (c) side areas of the torso region.

21. The wetsuit recited in claim 10, wherein the first backing layer has less stretch than the polymer foam layer.

22. The wetsuit recited in claim 10, wherein the first backing layer and the second backing layer each have less stretch than the polymer foam layer.

23. The wetsuit recited in claim 10, wherein the polymer foam layer is neoprene.

24. A wetsuit for aquatic activities, the wetsuit comprising a plurality of material elements joined to define a torso region, a pair of arm regions, and a pair of leg regions, at least one of the material elements including:

a neoprene layer having a first surface and an opposite second surface;

a first backing layer secured to the first surface of the neoprene layer, the first backing layer forming at least a portion of an exterior surface of the wetsuit; and a second backing layer secured to the second surface of the neoprene layer, the second backing layer forming at least a portion of an interior surface of the wetsuit, the wetsuit including a first plurality of sipes extending through at least the first backing layer, the first plurality of sipes being coaxially aligned with one another and spaced apart from one another to form a discontinuous line.

25. The wetsuit recited in claim 24, wherein the first plurality of sipes expose a portion of the first surface of the neoprene layer.

26. The wetsuit recited in claim 24, further including a second plurality of sipes extending through at least the second backing layer, the second plurality of sipes being aligned with one another and spaced apart from one another to form a discontinuous line.

27. The wetsuit recited in claim 24, wherein the torso region has a longitudinal axis dividing the torso region into a first lateral side and a second lateral side, wherein the first plurality of sipes extend from the first lateral side of the torso region in a U-shape across the longitudinal axis to the second lateral side of the torso region.

28. A wetsuit for aquatic activities, the wetsuit comprising:

a first material element including a first base layer and a first backing layer contiguous with and secured to the first base layer, the first base layer being formed from a thermal insulation material; and a second material element including a second base layer and a second backing layer contiguous with and secured to the second base layer, the second base layer being formed from the thermal insulation material having an even thickness throughout the second base layer, and the second backing layer forming at least a portion of an exterior surface of the wetsuit and including a first plurality of sipes extending through at least a portion of the second backing layer, the first backing layer having less stretch than the second backing layer.

29. The wetsuit recited in claim 28, wherein the second backing layer is secured to a first surface of the second base layer, a third backing layer is secured to a second surface of the second base layer that is opposite the first surface, and a second plurality of sipes extend through at least a portion of the third backing layer.

30. The wetsuit recited in claim 28, wherein the first plurality of sipes are aligned with one another and spaced apart from one another to form a discontinuous line.

31. The wetsuit recited in claim 30, wherein the wetsuit has a torso region and a longitudinal axis dividing the torso region into a first lateral side and a second lateral side and wherein the second backing layer defines a portion of the torso region and the first plurality of sipes extend from the first lateral side of the torso region in a U-shape across the longitudinal axis to the second lateral side of the torso region.

32. The wetsuit recited in claim 28, wherein the second backing layer includes a second plurality of sipes that are parallel to the first plurality of sipes.

* * * * *

UNITED STATES PATENT AND TRADEMARK OFFICE

CERTIFICATE OF CORRECTION

PATENT NO. : 8,578,512 B2
APPLICATION NO. : 13/213634
DATED : November 12, 2013
INVENTOR(S) : Moore et al.

It is certified that error appears in the above-identified patent and that said Letters Patent is hereby corrected as shown below:

On the Title Page

Item (73) Assignee:

"Nike, Inc." is replaced with

--Hurley International, LLC--

Signed and Sealed this
Nineteenth Day of August, 2014

Michelle K. Lee

Michelle K. Lee
*Deputy Director of the United States Patent and Trademark Office*